US006120120A

United States Patent [19]

Imai

[11] Patent Number: 6,120,120

[45] Date of Patent: Sep. 19, 2000

[54] INK JET APPARATUS AND INK JET RECORDER

[75] Inventor: Koji Imai, Inuyama, Japan

[73] Assignee: Brother Kogyo Kabushiki Kaisha, Nagoya, Japan

[21] Appl. No.: 09/134,867

[22] Filed: Aug. 17, 1998

[30] Foreign Application Priority Data

| | | | |
|---|---|---|---|
| Aug. 19, 1997 | [JP] | Japan | 9-222523 |
| Aug. 19, 1997 | [JP] | Japan | 9-222524 |
| Aug. 19, 1997 | [JP] | Japan | 9-222525 |

[51] Int. Cl.[7] ..... B41J 29/38

[52] U.S. Cl. ..... 347/11; 347/11; 347/14

[58] Field of Search ..... 347/9–11, 14, 347/68, 70

[56] References Cited

U.S. PATENT DOCUMENTS

| | | | |
|---|---|---|---|
| 4,514,742 | 4/1985 | Suga et al. | 347/85 |
| 4,879,568 | 11/1989 | Bartky et al. | 347/69 |
| 4,887,100 | 12/1989 | Michaelis et al. | 347/66 |
| 4,897,665 | 1/1990 | Aoki | 347/10 |
| 4,972,211 | 11/1990 | Aoki | 347/11 |
| 4,992,808 | 2/1991 | Bartky et al. | 347/69 |
| 5,003,679 | 4/1991 | Bartky et al. | 29/25.35 |
| 5,028,936 | 7/1991 | Bartky et al. | 347/69 |
| 5,521,619 | 5/1996 | Suzuki et al. | 347/10 |
| 5,757,392 | 5/1998 | Zhang | 347/14 |

FOREIGN PATENT DOCUMENTS

| | | |
|---|---|---|
| 0 738 602 A2/A3 | 10/1996 | European Pat. Off. . |
| 0 895 862 A1 | 2/1999 | European Pat. Off. . |
| 8-258256 | 10/1996 | Japan . |
| 09-029961 | 2/1997 | Japan . |
| WO 95/25011 | 9/1995 | WIPO . |
| WO 96/26073 | 8/1996 | WIPO . |

*Primary Examiner*—John Barlow
*Assistant Examiner*—Craig A. Hallacher
*Attorney, Agent, or Firm*—Oliff & Berridge, PLC

[57] ABSTRACT

The ink jet apparatus of an ink jet printer includes an ink jet head. The head has an ink channel, a nozzle, and an actuator for ejecting ink from the channel through the nozzle. A drive unit can drive the actuator. A control unit generates print data, on which the control unit is based to control the drive unit. A stop pulse data generator carries out a logical operation of the print data for each print cycle Tm and the print data for the next print cycle Tm+1 to generate a predetermined stop pulse data if the former data is a data for execution of printing and if the latter data is a data for no execution of printing. After printing is executed in accordance with the print data for the cycle Tm, the drive unit is based on the stop pulse data to drive the actuator so as to damp the pressure wave vibration generated in the channel.

23 Claims, 25 Drawing Sheets

INK JET APPARATUS AND INK JET RECORDER

BACKGROUND OF THE INVENTION

1. Field of the Invention

The present invention relates to ink jet apparatus. In particular, the invention relates to an ink jet apparatus for ejecting ink to form an image on a recording medium, and an ink jet recorder including the ink jet apparatus.

2. Description of Related Art

Recently, the market for non-impact printers has enlarged greatly in place of the market for impact printers. Among the non-impact printers, ink jet printers may have the simplest principles and be easiest of multiple gradation and colorization. Ink jet printers of the drop-on-demand type eject the only ink for printing. Ink jet printers of this type are coming rapidly into wide use because of high ejection efficiency and low running costs.

For example, U.S. Pat. Nos. 5,028,936, 5,003,679, 4,992,808, 4,887,100 and 4,879,568 disclose ink jet apparatus of the shear mode type for use in a drop-on-demand type ink jet printer. Piezoelectric material is used for the disclosed apparatus. FIGS. 24A and 24B and FIG. 25 of the accompanying drawings show a conventional ink jet apparatus of this type, which comprises a print head 600. The head 600 includes a base wall 601 and a top wall 602 between which extend shear mode actuator walls 603*a*–603*h*. The actuator walls 603*a*–603*h* have upper parts 605 and lower parts 607 made of piezoelectric material. The wall parts 605 and 607 are bonded to the walls 602 and 601, respectively, and polarized in the opposite directions of arrows 609 and 611, respectively. The actuator walls 603*a*, 603*c*, 603*e* and 603*g* pair with the actuator walls 603*b*, 603*d*, 603*f* and 603*h*, respectively, to define an ink channel 613 between each pair of actuator walls. The actuator walls 603*b*, 603*d* and 603*f* pair with the actuator walls 603*c*, 603*e* and 603*g*, respectively, to define an air space 615 between each pair of actuator walls. The spaces 615 are narrower than the channels 613.

At one end of the channels 613 is secured a nozzle plate 617 formed with nozzles 618 each for one of the channels. The other ends of the channels 613 are connected through a manifold 626 to an ink cartridge or another ink supply (not shown). The manifold 626 includes a front wall 627 and a rear wall 628. The front wall 627 is formed with holes each communicating with one of the channels 613. The rear wall 628 closes the space in the rear of the front wall 627 between the rear ends of the base wall 601 and top wall 602. Ink can be supplied from the supply to the space between the front wall 627 and rear wall 628, and then be distributed to the channels 613.

The longer four sides of each channel 613 are lined with an electrode 619. The longer four sides of each space 615 are lined with an electrode 621. The outer sides of the actuator walls 603*a* and 603*h* are each lined with an electrode 621. The electrodes 619 and 621 take the form of metallized layers. The electrode 619 around each channel 613 is passivated with an insulating layer (not shown) for insulation from ink. The electrodes 619 in the channels 613 are connected to a drive circuit 640. Under the control of a control circuit 641, the drive circuit 640 can generate a voltage and apply it to these electrodes. The other electrodes 621 are connected to a ground return 623.

In operation, the voltage applied to the electrode 619 in each channel 613 causes the actuator walls facing the channel to deform piezoelectrically in such directions that the channel enlarges in volume. If, as shown in FIG. 25, a predetermined voltage of E volts is applied to the electrode 619 between the actuator walls 603*e* and 603*f*, for instance, electric fields are generated in these walls in the opposite directions of arrows 631 and 632. This deforms the walls 603*e* and 603*f* piezoelectrically in such directions that the associated channel 613 enlarges, reducing the pressure in this channel to a negative pressure.

The voltage applied to the electrode 619 is held for a period L/V where L is the channel length and V is the sound velocity in the ink in the channel 613. While the voltage is applied, ink is supplied from the supply to the channel 613. The period L/V is the one-way propagation delay time T which it takes for the pressure wave in the channel 613 to be propagated one way longitudinally of the channel.

According to the theory of pressure wave propagation, the negative pressure in the channel 613 reverses into a positive pressure when the period L/V passes after the voltage is applied to the electrode 619. When the period L/V passes after the voltage is applied to the electrode 619, the voltage is returned to zero volt. This allows the deformed actuator walls 603*e* and 603*f* to return to their original condition (FIGS. 24A and 24B), generating a positive pressure in the channel 613. This pressure is added to the pressure reversed to be positive. As a result, a relatively high pressure develops in that portion of the channel 613 which is near to the associated nozzle 618, ejecting ink out through the nozzle. The ejected ink sticks to a surface of printing paper or another recording medium to form an image on it.

As stated above, pressure wave vibration of ink is generated in the channel 613 to eject ink out through the nozzle 618. The applicant has devised, in U.S. patent application Ser. No. 09/007,756, substantial cancellation of the residual pressure wave vibration of ink in the channel 613 after the ejection. The cancellation involves increasing and decreasing the volume of the channel 613 by applying the voltage of E volts to the electrode 619 again at a predetermined time and subsequently returning the voltage to 0 volt. The cancellation damps the residual pressure wave vibration in the channel 613 quickly and early. This prevents ink from being ejected or dropped accidentally through the nozzle 618 by the residual vibration. Besides, this enables early transition to the process in accordance with the next print command. It is therefore possible to form a more faithful image on the recording medium, and improve the print speed.

After ink is ejected out through the nozzle 618 in a predetermined cycle, there may or may not be a print command for the next cycle. The applicant has also devised in the above-identified U.S. patent application, cancelling the residual pressure wave vibration if there is no print command for the next cycle, and carrying out no such cancellation if there is a print command for this cycle.

In other words, if there is no print command for the cycle following a predetermined cycle, an accidental drop of ink may occur, and therefore the residual pressure wave vibration should be cancelled. This results in better image formation not stained or spotted by scattered ink.

If there is a print command for the next cycle, the residual pressure wave vibration in the channel 613 should be utilized positively. Specifically, this vibration should be added to the pressure wave vibration generated in accordance with the command for this cycle. This generates greater pressure wave vibration for ejection of a larger ink droplet through the nozzle 618. Larger ink droplets increase the print density to form a thicker and clearer image.

In order to switch between the execution and no execution of such cancellation depending on whether there is a print command for the cycle following a predetermined cycle, it is necessary to accurately control the voltage application from the drive circuit 640 to the electrode 619. This requires the control circuit 641 to accurately control the drive circuit 640.

SUMMARY OF THE INVENTION

It is accordingly one object of the invention to provide an ink jet apparatus which can prevent accidental drops of ink by cancelling pressure wave vibration of ink only when there is a need to do so. Another object is to provide an ink jet apparatus which can prevent accidental drops of ink by employing a control unit or a drive unit which is cheap and simple. Still another object is to provide an ink jet recorder including such an apparatus.

In accordance with the invention, an ink jet apparatus is provided for a printer. The apparatus includes an ink jet head having a nozzle and an ink channel formed therein. The nozzle and the channel communicate with each other. The head also has an actuator for changing the volume of the channel to eject ink from the channel through the nozzle. The apparatus further includes a drive unit for driving the actuator. The apparatus further includes a control unit for generating a print data for every print cycle, and controlling the drive unit with the data. The apparatus further includes a stop pulse data generator for carrying out a logical operation of the print data for each print cycle Tm and the print data for the next print cycle Tm+1 to generate a stop pulse data if the data for the cycle Tm is a data for execution of printing and if the data for the cycle Tm+1 is a data for no execution of printing. After printing is executed in accordance with the print data for the cycle Tm, the drive unit drives the actuator based on the stop pulse data so as to damp the pressure wave vibration generated in the channel.

Only if the print data for the cycle Tm has a print command, and only if the print data for the cycle Tm+1 has no print command, the stop pulse data generator generates a predetermined stop pulse data. A data for execution of printing may be a bit data "1". A data for no execution of printing may be a bit data "0". In this case, if the data bits for the cycles Tm and Tm+1 are "1" and "0", respectively, the stop pulse data generator carries out such a logical operation of the bits as to generate a bit data "1". When the bit data "1" is generated, the control unit drives the actuator to eject ink from the channel in accordance with the print data "1" for the cycle Tm and, thereafter, damp the pressure wave vibration generated in the channel due to the ejection. Therefore, only if there is no ejection data for the cycle Tm+1 following the cycle Tm for which there is an ejection data, it is possible to execute cancellation for cancelling or damping the pressure wave vibration of ink. The logical operation may be the logical multiply of the print bit data for the cycle Tm and the inverse of the print bit data for the next cycle Tm+1.

As shown in the first, second and third embodiments of t he invention, the stop pulse data generator may be positioned in the control unit. By positioning this generator in the control unit, not in the drive unit, it is possible to execute, with a conventional drive unit and a conventional print head used, the cancellation for cancelling or damping the pressure wave vibration of ink.

In accordance with the first embodiment, the ink jet apparatus may further include a first storer for storing the print data for every print cycle and a second storer for storing the print data for every print cycle. When the first storer stores the data for the print cycle Tm, the second storer stores the data for the next cycle Tm+1. The stop pulse data generator may generate the stop pulse data by carrying out the logical operation of the data stored in the two storers.

The storers may be positioned in the control unit. In this case, the ink jet apparatus may further include a data selector connected to the drive unit. The selector can select the stop pulse data output from the stop pulse 4 data generator or the print data output from the second storer. The selector of the first embodiment is positioned in the control unit. Therefore, it is not necessary to provide separate or independent lines for transferring the stop pulse data and the print data from the control unit to the drive unit. The selectors of the second and third embodiments are each positioned in the associated drive unit. The data selector may consist of a plurality of selectors depending on the number of data channels generated in the control unit.

In the ink jet apparatus according to the first embodiment, the nozzle may consist of sub-nozzles such as reference numeral 618 shown in FIGS. 24A and 24B, and the ink channel may consist of sub-channels such as reference numeral 615 shown in FIGS. 24A and 24B. Likewise, the actuator may consist of sub-actuators. The sub-nozzles each communicate with one of the sub-channels. The sub-actuators can each change the volume of one of the sub-channels. In this case, the apparatus may further include a memory for storing a plurality of print data each associated with one of the sub-actuators. The second storer may carry out a serial-parallel conversion of print data by storing a plurality of print data transferred in parallel from the memory, and by outputting the stored data in series. The second storer may feed back the serially output data thereto. The first storer may serially receive the data output serially from the second storer. If the data selector selects the stop pulse data, the first storer may serially output the received data in synchronism with the serial output from the second storer. The stop pulse data generator may generate the stop pulse data by carrying out the logical operation of the data output in series from the two storers. This makes it possible to produce a stop pulse data for the data associated with each sub-actuator. Therefore, the single control unit is sufficient for the sub-nozzles, sub-channels and sub-actuators.

The control unit of the ink jet apparatus according to the first embodiment may generate a print clock consisting of first and second pulses. The first pulses, such as ICKfn−1 shown in FIG. 5, are associated with ejection of ink from the ink channels. The second pulses, such as ICKsn−1 shown in FIG. 5, are associated with cancellation of pressure wave vibration generated in the channels. The drive unit may further include a serial-parallel converter for carrying out a serial-parallel conversion of print data or stop pulse data by storing the print data or the stop pulse data output in series from the data selector of the control unit, and by outputting the stored data in parallel. Because the drive unit includes a serial-parallel converter, the transfer line can be single. This reduces the number of transfer lines, lowering the costs, in comparison with a case where print data or stop pulse data are output in parallel from a control unit to a drive unit.

In accordance with the second and third embodiments, the ink jet apparatus may further include a first storer for storing the print data for every print cycle and a second storer for storing the print data for every print cycle. When the first storer stores the data for the print cycle Tm, the second storer stores the data for the cycle Tm+1. The stop pulse data generator may generate the stop pulse data by carrying out the logical operation of the data stored in the two storers. The storers may be housed in the control unit.

In accordance with the second and third embodiments, the nozzle may consist of sub-nozzles, and the ink channel may consist of sub-channels. Likewise, the actuator may consist of sub-actuators. The sub-nozzles each communicate with one of the sub-channels. The sub-actuators can each change the volume of one of the sub-channels. The ink jet apparatus may further includes a memory for storing a plurality of print data each associated with one of the sub-actuators. The second storer may store a plurality of data transferred in parallel from the memory, carry out a serial-parallel conversion of the stored data and output the serial data. The first storer may receive the data from the second storer while outputting the data for the print cycle preceding the cycle associated with the received data. The stop pulse data generator may generate the stop pulse data by carrying out the logical operation of the data output in series from the two storers.

In the ink jet apparatus according to the second and third embodiments, the control unit may generate a print clock including a first pulse and a second pulse in each print cycle. The first pulse is associated with ejection of ink from the sub-channels. The second pulse is associated with cancellation of pressure wave vibration generated in the sub-channels. The control unit may also generate a switching signal in synchronism with the clock. The drive unit may further include a first serial-parallel converter for storing the print data output in series from the second storer of the control unit, carrying out a serial-parallel conversion of the stored print data, and outputting the parallel print data. The drive unit may further include a second serial-parallel converter for storing the stop pulse data output in series from the stop pulse data generator of the control unit, carrying out a serial-parallel conversion of the stored stop pulse data, and outputting the parallel stop pulse data. The drive unit may further include a data selector for selecting, in accordance with the switching signal generated by the control unit, the print data output from the first converter or the stop pulse data output from the second converter. During each print cycle, the selector selects print data and thereafter stop pulse data. The drive unit may further include a drive data generator for generating a plurality of drive data each associated with one of the print data, by carrying out a logical operation of each print data or each stop pulse data selected by the selector and the print clock generated by the control unit. Because the ink jet apparatus according to these embodiments includes two serial-parallel converters, only two data transfer lines from the control unit to the drive unit are sufficient for the print data and the stop pulse data. It is therefore possible to reduce the number of transfer lines as compared with parallel transfer.

In the ink jet apparatus of the second embodiment, the drive unit may further include a third storer for storing, in synchronism with the print clock generated by the control unit, the print data or the stop pulse data selected by the data selector. The drive data generator may generate the drive data by carrying out the logical operation of each print data or each stop pulse data stored in the third storer and the print clock. Because the print data or the stop pulse data selected by the selector are stored once in the third storer, it is possible to increase the degree of freedom to time the logical operation of each print data or each stop pulse data and the print clock when the drive data generator generates drive data. This makes it easy to optimize the print clock waveform for the structure of the sub-nozzles, sub-channels and sub-actuators.

In the ink jet apparatus according to the third embodiment, the drive unit may further include a fourth storer for storing in synchronism with the print clock the print data output in parallel from the first serial-parallel converter. The drive unit may further include a fifth storer for storing in synchronism with the print clock the stop pulse data output in parallel from the second serial-parallel converter. In accordance with the switching signal generated by the control unit, the data selector may select the print data in the fourth storer and thereafter the stop pulse data in the fifth storer during each print cycle. Thus, the print data and the stop pulse data output in parallel from the first and second converters, respectively, are stored once in the fourth and fifth storers, respectively. It is therefore possible to improve, in comparison with the second embodiment, the degree of freedom to time the logical operation of each print data or each stop pulse data and the print clock when the drive data generator generates drive data.

In the ink jet apparatus according to the fourth and fifth embodiments, the nozzle may consist of sub-nozzles, and the ink channel may consist of sub-channels. Likewise, the actuator may consist of sub-actuators. The sub-nozzles each communicate with one of the sub-channels. The sub-actuators can each change the volume of one of the sub-channels. The control unit may generate a print clock including a first pulse and a second pulse in each cycle. The first pulse is associated with ejection of ink from the sub-channels. The second pulse is associated with cancellation of pressure wave vibration generated in the sub-channels. The control unit may also generate a switching signal in synchronism with the clock. The control unit may serially output a plurality of print data each associated with one of the sub-actuators. The drive unit may include a first serial-parallel converter for storing the print data output in series from the control unit, outputting the stored data in series, carrying out a serial-parallel conversion of the stored data and outputting the parallel data. The drive unit may also include a second serial-parallel converter for receiving the print data output in series from the first converter, carrying out a serial-parallel conversion of the received data and outputting the parallel data. The stop pulse data generator may generate the stop pulse data by carrying out the logical operation of the print data output in parallel from the first and second converters. The drive unit may also include a data selector for selecting, in accordance with the switching signal generated by the control unit, the print data output in parallel from the first converter or the stop pulse data output in parallel from the stop pulse data generator. The drive unit may further include a drive data generator for generating a plurality of drive data each associated with one of the print data, by carrying out a logical operation of each print data or each stop pulse data selected by the selector and the print clock generated by the control unit.

The stop pulse data generator of the ink jet apparatus according to the fourth and fifth embodiments is positioned in the drive unit. This apparatus is preferable in simplifying the control unit, as compared with the apparatus according to the first, second and third embodiments. The data selector is positioned in the drive unit, and this unit has serial-parallel converters in it, as is the case with the second and third embodiments. Therefore, one data transfer line from the control unit to the drive unit is sufficient. This reduces the number of data transfer lines in comparison with parallel output.

In accordance with the fourth embodiment, the drive unit may further include a first storer for storing, in synchronism with the print clock generated by the control unit, the print data or the stop pulse data selected by the data selector. The drive data generator may generate the drive data by outputting the logical product of each print data or each stop pulse data stored in the storer and the print clock. This increases the degree of freedom to time the logical operation of the print data or the stop pulse data and the print clock when the drive data are generated. This makes it easy to optimize the print clock waveform for the structure of the sub-nozzles, sub-channels and sub-actuators.

In accordance with the fifth embodiment as a modification of the fourth embodiment, the drive unit may also include a second storer for storing, in synchronism with the print clock, the print data output in parallel from the first serial-parallel converter. The drive unit may further include a third storer which stores, in synchronism with the clock, the print data output in parallel from the second converter, and which is connected to the stop pulse data generator. In accordance with the switching signal generated by the control unit, the data selector may select the print data in the second storer and thereafter the stop pulse data generated by the stop pulse data generator during each print cycle.

In the ink jet apparatus according to the invention, the drive unit may drive the actuator in each print cycle to first execute the ejection of ink from the channel by once increasing and thereafter decreasing, or once decreasing and thereafter increasing, the volume of the channel, and subsequently execute the cancellation for damping the pressure wave vibration by again increasing and thereafter decreasing, or again decreasing and thereafter increasing, the channel volume. On the basis of the one-way propagation delay time which it takes for a pressure wave of ink to be propagated one way in the channel, the control unit may determine, in each print cycle, a first period when the drive unit executes the ejection, a second period when the drive unit executes the cancellation, and a third period after the ejection ends and until the cancellation starts.

Therefore, the drive unit executes the ejection by driving the actuator to increase the volume of the ink channel once. This reduces the pressure in the channel once so that ink flows into the channel. Subsequently, at the end of the first period, the actuator is driven to decrease the channel volume. This develops relatively high pressure in the channel, ejecting ink out through the nozzle. Thereafter, the drive unit executes the cancellation by increasing the channel volume again at the end of the third period, and decreasing the volume at the end of the second period. This makes it possible to execute the ejection for a suitable or proper time in accordance with the one-way propagation delay time. It is therefore possible to eject ink securely. It is also possible to execute the cancellation at suitable timing in accordance with the one-way propagation delay time, and therefore cancel the pressure wave vibration of ink very well. It is consequently possible to cancel the vibration better, and therefore form a more accurate image and improve the print speed better.

Even if ink is ejected by once decreasing and thereafter increasing the channel volume, and subsequently the vibration is cancelled by again decreasing and thereafter increasing the volume, it is possible to achieve effect similar to that stated above.

The actuator may be of the voltage-driven type. The drive unit may apply drive signals of the same voltage to the actuator for the ejection and the cancellation. In this case, one power circuit is sufficient, and therefore the drive unit can be simple in structure. The drive of the actuator is controlled by switching between the application and no application of voltage, thereby simplifying the drive control process. It is therefore possible to make the structure and control of the apparatus simpler. The side walls of the ink channel may be made piezoelectric material. The actuator may consist of the piezoelectric walls. This makes the actuator simple in structure, durable and cheaper.

According to the first embodiment of the ink jet apparatus, the data selector may consist of a plurality of selectors associated with the sub-actuators, respectively.

According to the fourth and fifth embodiment of the ink jet apparatus, the data selector may consist of a plurality of selectors associated with the sub-actuators, respectively, and the stop pulse data generator may consist of a plurality of data generators associated with the sub-actuators, respectively.

The terms used in the foregoing summary and the appended claims correspond, but are not limited, to the counterparts of the embodiments as follows: The drive units correspond to the drive circuits; The control units correspond to the control circuits; The first and second storers correspond to some of the shift registers; The stop pulse data generators correspond to the inverter gates, some of the AND gates, etc.; The data selectors correspond to the electronic switches; The drive data generators correspond to the other AND gates; The drive signal generators correspond to the output circuits; The third, fourth and fifth storers correspond to the data latches; The first periods each correspond to the period between the points t1 and t2 in the associated embodiment; The second periods each correspond to the period between the points t3 and t4 in the associated embodiment; The third periods each correspond to the period between the points t2 and t3 in the associated embodiment.

BRIEF DESCRIPTION OF THE DRAWINGS

Preferred embodiments of the invention will be described with reference to the accompanying drawings, in which.

DETAILED DESCRIPTION OF PREFERRED EMBODIMENTS

First Embodiment

Figure 1:
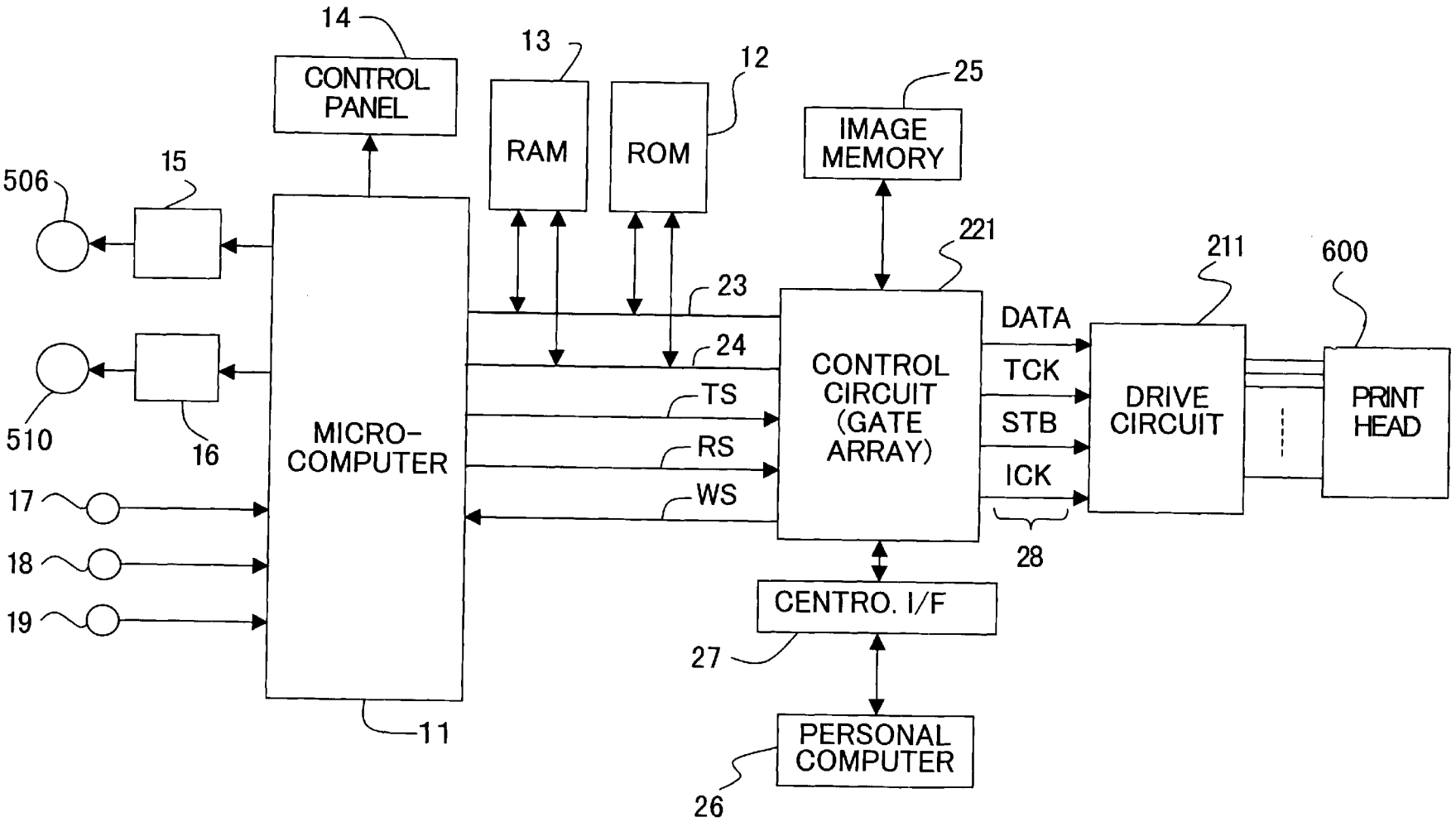
FIG. 1 is a block diagram of the electric system of an ink jet printer including an ink jet apparatus according to a first embodiment of the invention.
Figure 2:
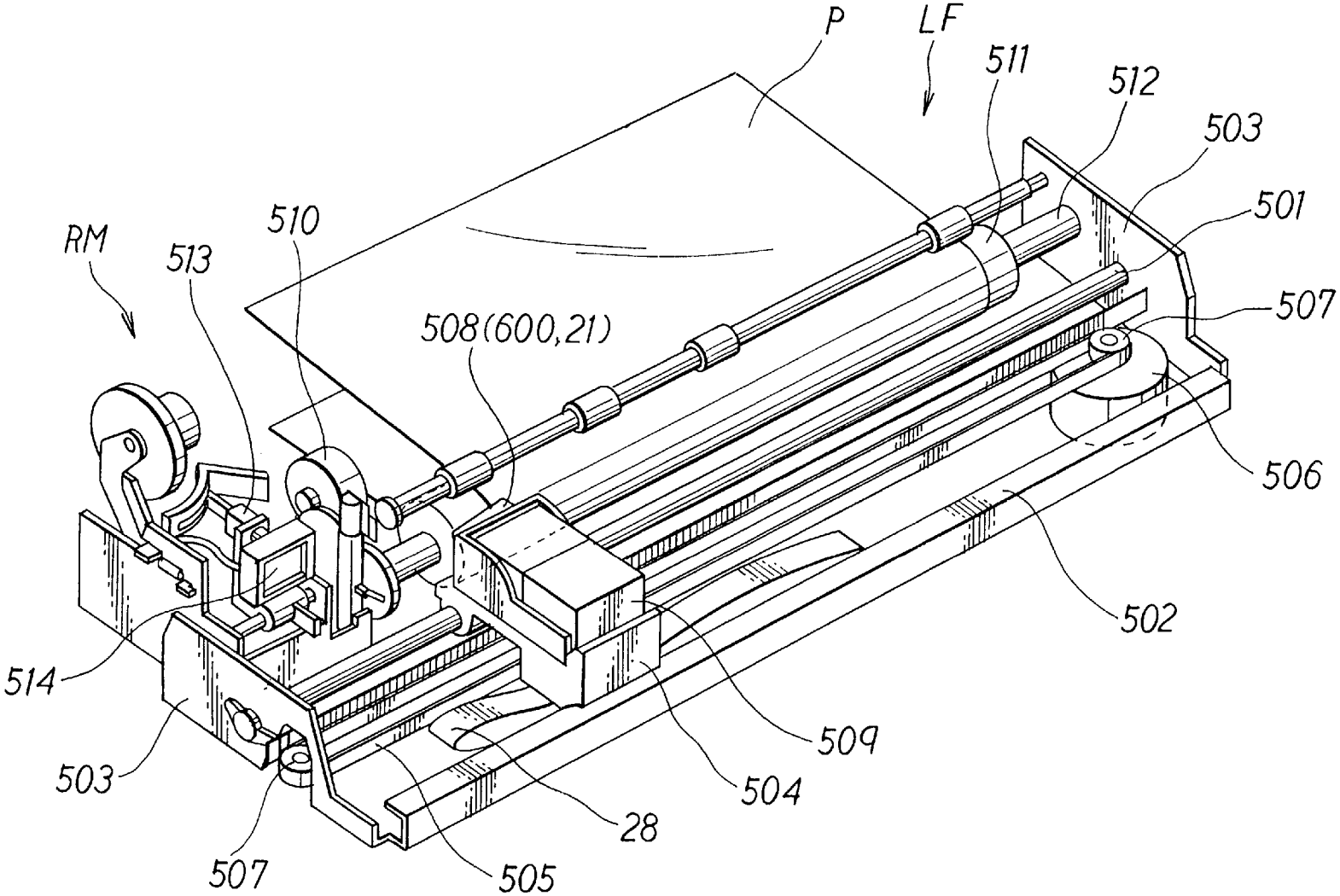
FIG. 2 is a schematic perspective view of the printer according to the embodiments of the invention.
Figure 24A:
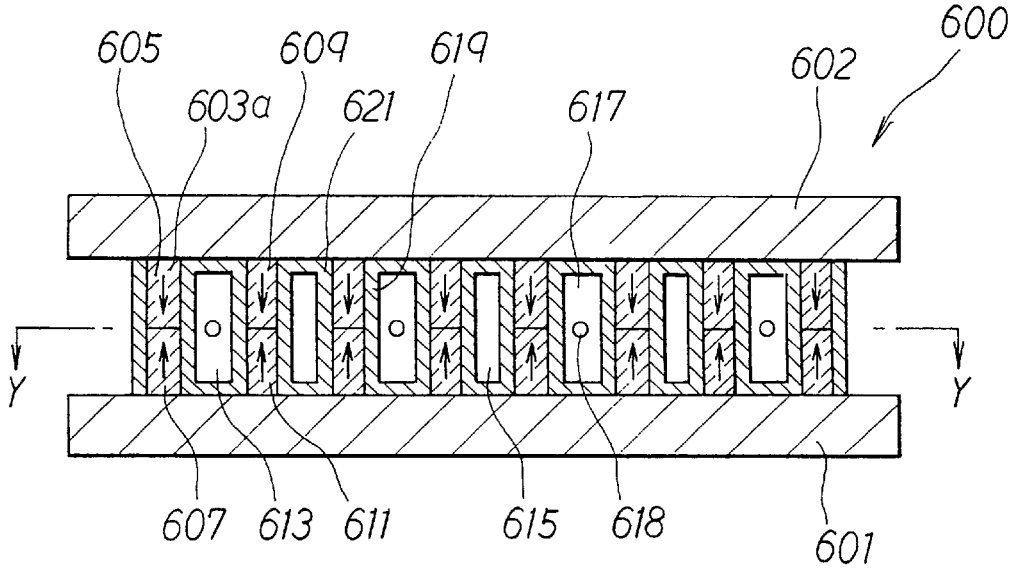
FIG. 24A is a sectional elevation of a print head which is common to a conventional ink jet apparatus and the apparatus according to the embodiments and which is taken on the line X—X of FIG. 24B.
Figure 24B:
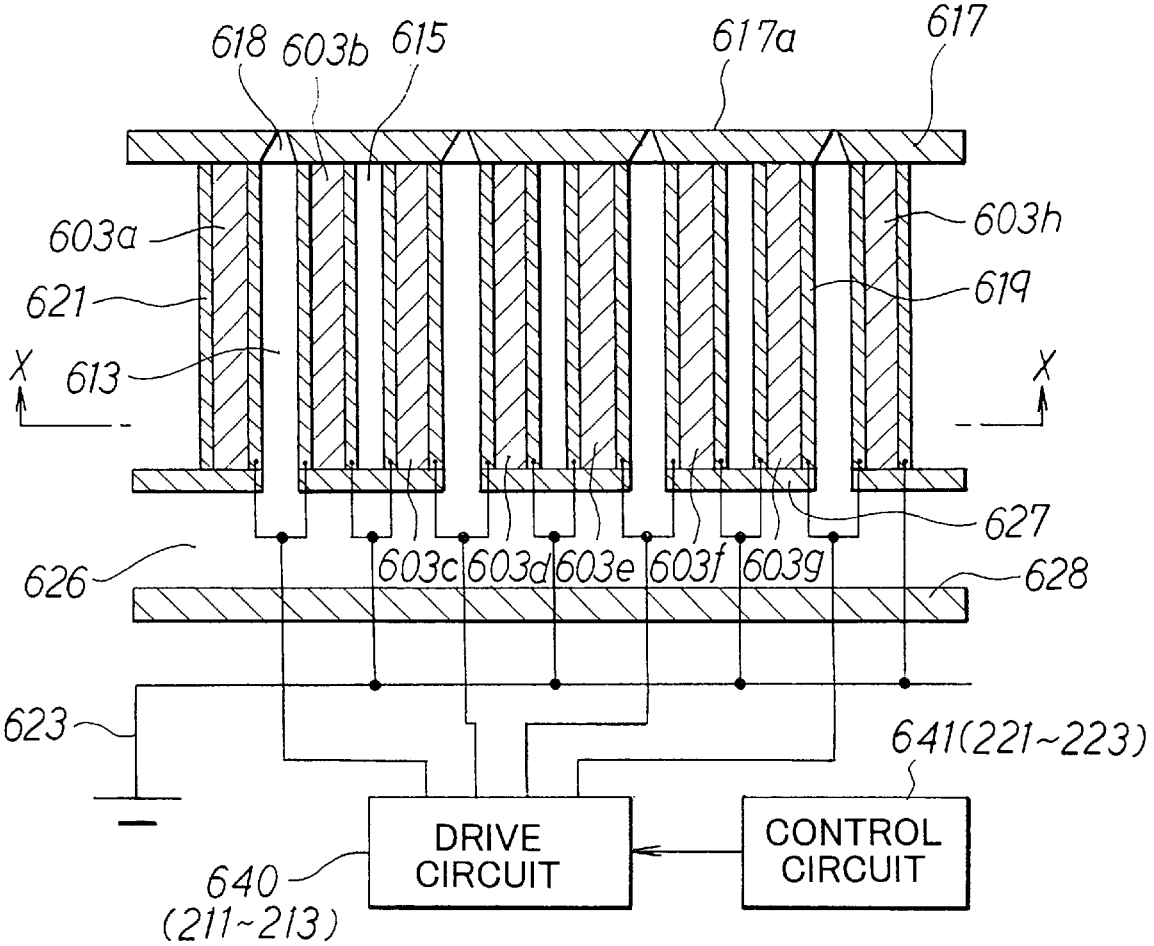
FIG. 24B is a sectional plan taken on the line Y—Y of FIG. 24A.
Figure 25:
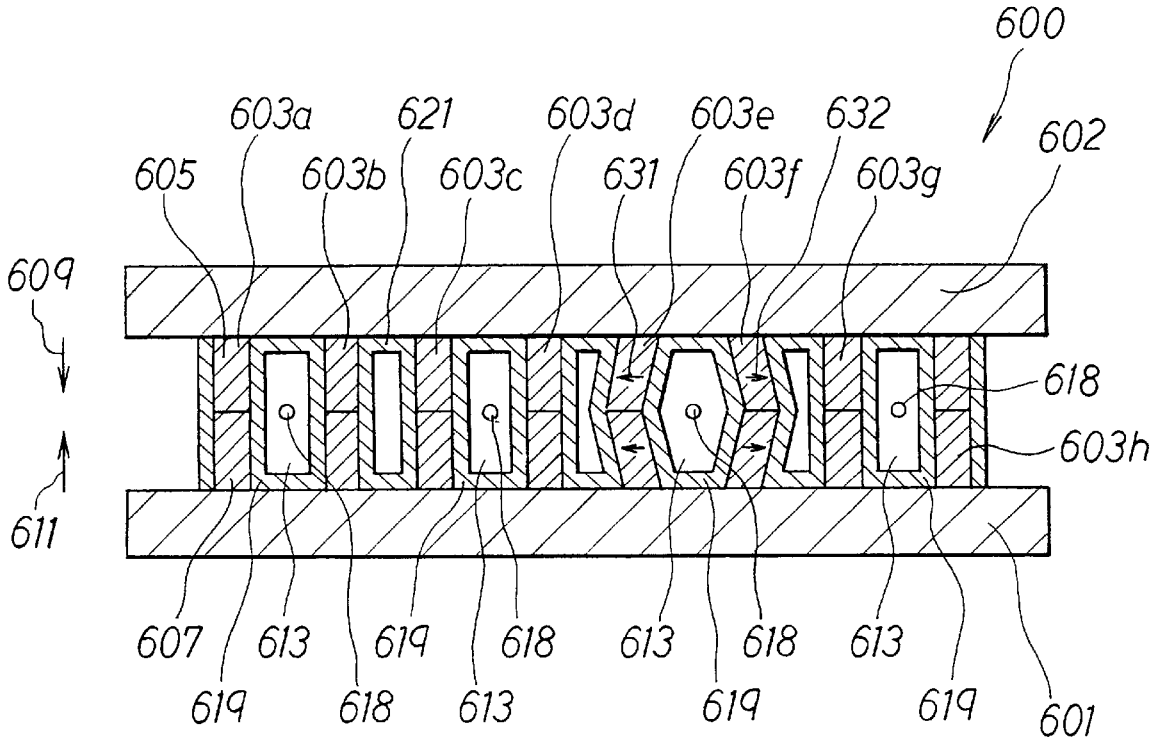
FIG. 25 is a sectional elevation of the print head of FIGS. 24A and 24B, showing the head operation.

Referring to FIGS. 1 and 2, an ink jet printer embodying the invention includes a print head 600, which is a 64-channel multi-nozzle head. The head 600 has 64 ink channels 613 (FIGS. 24A, 24B and 25). Because this head is basically identical in mechanical structure to the conventional head 600 shown in FIGS. 24A, 24B and 25, the description of it will be omitted. Referring to FIG. 1, an ink jet printer has a controller including a one-chip microcomputer 11, a ROM 12 and a RAM 13. The microcomputer 11 is connected to a control panel 14, motor energization circuits 15 and 16, a paper sensor 17, a home position sensor 18, a carriage position sensor 19, etc. The panel 14 can be used for the users' print instructions etc. Referring to FIGS. 1 and 2, the energization circuits 15 and 16 can energize a carriage (CR) motor 506 and a feed (LF) motor 510, respectively. The paper sensor 17 can detect the front end of a sheet of printing paper P as a recording medium. The home position sensor 18 can detect the home position or origin when a sheet P is printed. The carriage position sensor 19 can detect the position of a carriage 504.

The print head 600 can be driven by a drive circuit 211, which is a one-chip IC. The drive circuit 211 is controlled by a control circuit 221, which is a gate array. As shown in FIGS. 24A and 24B, the electrodes 619 in the ink channels 613 of the head 600 are connected to the drive circuit 211. Under the control of the control circuit 221, the drive circuit 211 can generate a voltage which is suitable for the head 600, and apply the voltage to the electrodes 619.

The microcomputer 11 is connected to the ROM 12, the RAM 13 and the control circuit 221 through an address bus 23 and a data bus 24. In accordance with a program stored in advance in the ROM 12, the microcomputer 11 can generate a print timing signal TS and a reset signal RS, and transfer them to the control circuit 221.

In accordance with a print timing signal TS and a reset signal RS, the control circuit 221 generates and transfers to the drive circuit 211: transfer data DATA which are print data for forming an image on a sheet of printing paper P on the basis of image data stored in an image memory 25; a transfer clock TCK in synchronism with the data DATA; a strobe signal STB; and a print clock ICK.

The signals DATA, TCK, STB and ICK are transferred through a flexible harness cable 28, which connects the circuits 211 and 221.

The control circuit 221 causes the image memory 25 to store the image data transferred from a personal computer 26 or other external apparatus through a Centronics interface 27. On the basis of Centronics data transferred from the computer 26 or the like through the interface 27, the control circuit 221 generates a Centronics data receive interrupt signal WS, and transfers it to the microcomputer 11.

Referring to FIG. 2, the printer includes a frame 503, to which a guide rod 501 and a guide rail 502 are fixed. The carriage 504 is supported on the rod 501 and rail 502 slidably along them. The carriage 504 is fastened to a timing belt 505, which can be driven by the carriage motor 506 to reciprocate the carriage. The belt 505 extends between a pair of pulleys 507, which are positioned near both ends of the rod 501 and rail 502. One of the pulleys 507 is connected to the drive shaft of the carriage motor 506.

The carriage 504 carries a head unit 508, which includes the print head 600 and the drive circuit 211. The head unit 508 is an ink jet unit for printing on a sheet of printing paper P by ejecting ink droplets. The carriage 504 also carries an ink cartridge 509 mounted removably on its rear to supply ink to the channels 613 of the head 600.

The printer also includes a feed mechanism LF for feeding a sheet of printing paper P. The mechanism LF includes a platen roller 511, which can be driven by the feed motor 510 to feed the sheet P. The shaft 512 of the roller 511 is supported rotatably by the frame 503.

On one side of the feed mechanism LF is positioned a maintenance and recovery mechanism RM for maintaining and recovering good condition of ink ejection from the print head 600. The mechanism RM includes a suction mechanism 513 and a preservation cap 514. While the head 600 is used, the ink in it may dry or dehydrate, and air bubbles may be produced in it. Besides, ink droplets may stick to the outer side of the nozzle plate 617 of the head 600. This may cause defective ejection of ink. In order to eliminate the defective condition of ejection, the suction mechanism 513 sucks ink out through the nozzles 618 with the cap 514 capping the nozzle plate 617. While the printer is not used, the cap 514 caps the plate 617 to function as a cover for preventing ink from drying.

Figure 3:
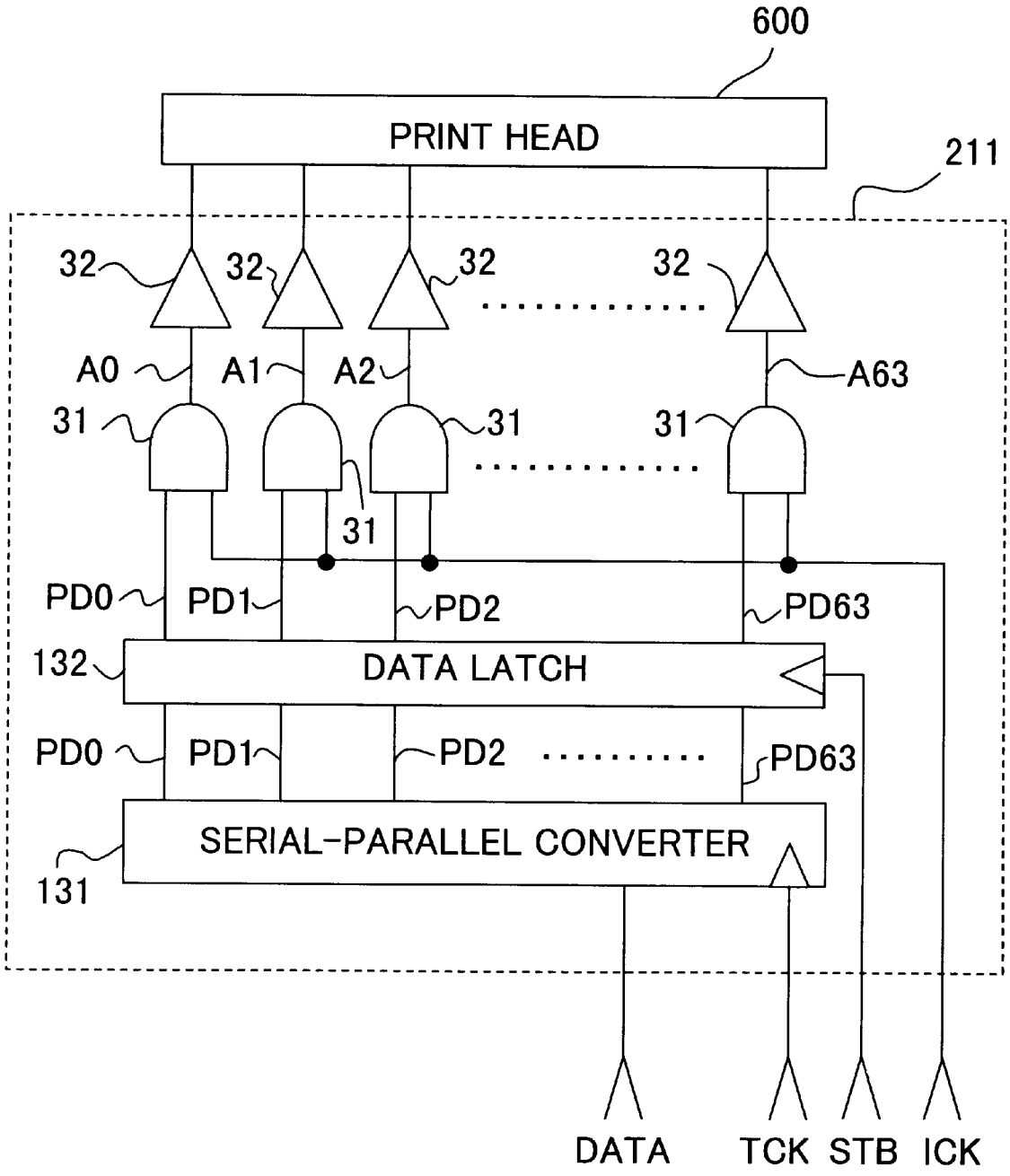
FIG. 3 is a block diagram of the drive circuit of the apparatus according to the first embodiment.

Referring to FIG. 3, the drive circuit 211 includes a serial-parallel converters 131, a data latch 132, 64 AND gates 31, and 64 output circuits 32, which are each connected to one of the channel electrodes 619 of the print head 600. The converter 131 is a 64-bit shift register.

The serial-parallel converter 131 receives transfer data DATA transferred serially in synchronism with a transfer clock TCK from the control circuit 221. When transfer clock pulses TCK rise, the converter 131 converts the serial data DATA into parallel data PD0–PD63.

Triggered by the rise of a strobe pulse STB from the control circuit 221, the latch 132 latches the parallel data PD0–PD63. After the data PD0–PD63 are latched, the data in the serial-parallel converter 131 can be changed. A detailed description will be given later of the timing relationship between the data latching and the data transfer to the converter 131.

The AND gates 31 output drive data A0–A63, which are the logical products of the parallel data PD0–PD63 from the data latch 132 and a print clock pulse ICK from the control circuit 221. The drive data A0–A63 are associated with the parallel data PD0–PD63, respectively.

On the basis of the drive data A0–A63, the output circuits 32 can generate a voltage which is suitable for the print head 600. Each circuit 32 can output the voltage to the associated channel electrode 619 of the head 600.

If the print head 600 did not have 64 channels, it would only be necessary for the output circuits 32, the AND gates 31, and the bits of the serial-parallel converter 131 to be equal in number to the channels.

Figure 4:
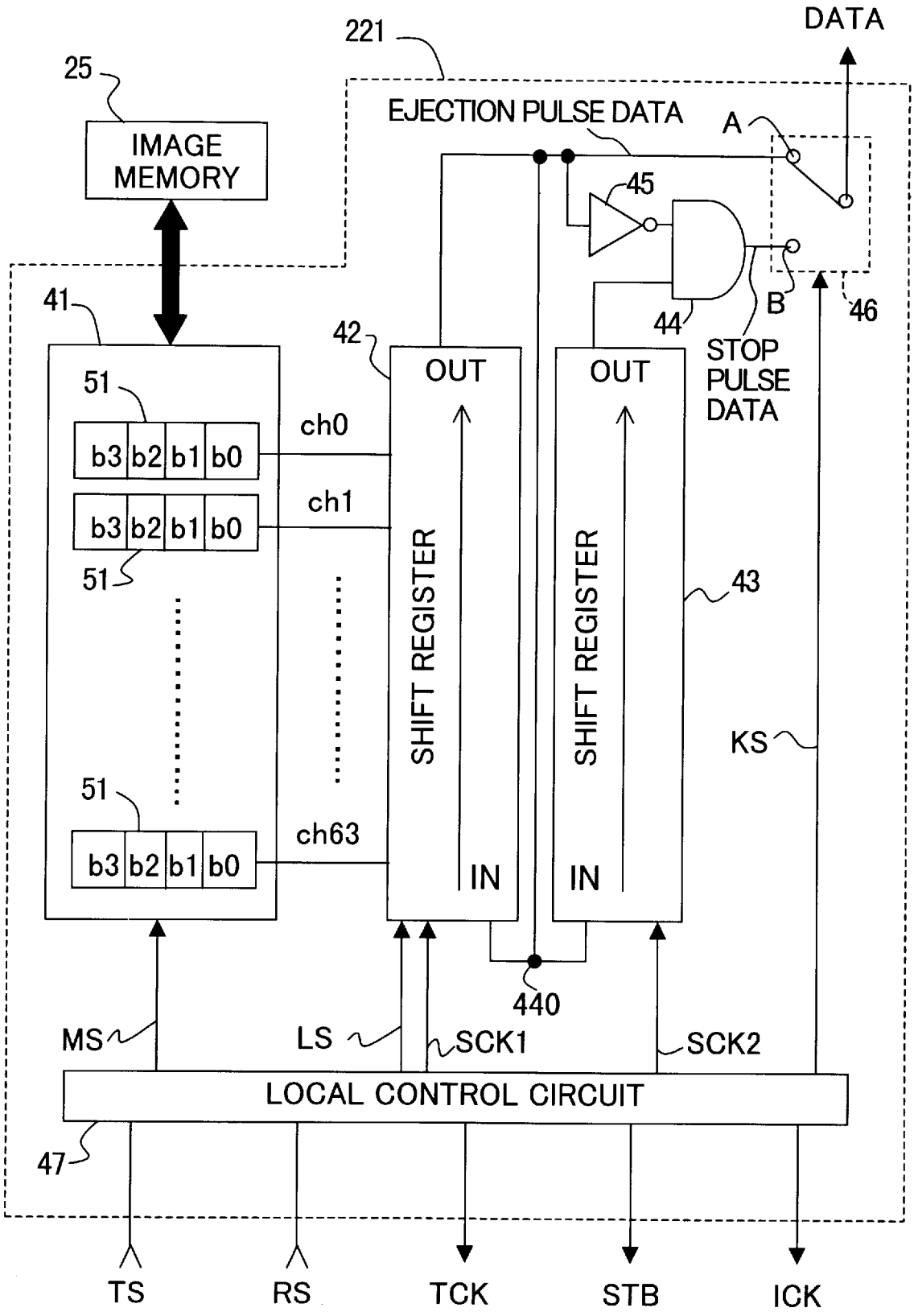
FIG. 4 is a block diagram of the control circuit of the apparatus according to the first embodiment.

Referring to FIG. 4, the control circuit 221 includes a local control circuit 47, a data setting circuit 41, a pair of 64-bit shift registers 42 and 43, an inverter gate 45, an AND gate 44, and an electronic switch 46. The setting circuit 41 includes 64 4-bit shift registers 51.

The data setting circuit 41 reads out in parallel the image data stored in the image memory 25, and stores 4 bits of the parallel image data in each shift register 51. In accordance with a set command signal MS, the image data stored in the minimum bits b0 of the shift registers 51 are transferred to the shift register 42. Then, the registers 51 shift the data in them by one bit toward their minimum bits b0, emptying their maximum bits b3. 4 times of the transfer to the register 42 empty all the bits of the registers 51. Then, other image data are transferred from the memory 25 to the registers 51.

Every time a load signal RDS rises, the shift register 42 receives image data ch0–ch63 from the 64 channels of the data setting circuit 41 in parallel. When shift clock pulses SCK1 rise, the register 42 outputs the data ch0–ch63 serially in that order, by one bit at a time, through its serial output terminal OUT. This makes a parallel-serial conversion of the image data. The serial data output from the register 42 are input serially through a junction 440 to the serial input terminals IN of the registers 42 and 43.

When shift clock pulses SCK2 rise, the shift register 43 outputs the data ch0–ch63 serially in that order through its serial output terminal OUT.

The image data ch0–ch63 are associated with the respective ink channels 613 of the print head 600. In accordance with each of the data ch0–ch63, voltage can be generated for application to the associated channel electrode 619. This controls the ejection of ink from the channels 613 during the ink ejection and the vibration cancellation.

The AND gate 44 receives the serial image data ch0–ch63 from the shift register 42 through the inverter gate 45 and the serial image data ch0–ch63 from the register 43. The AND gate 44 outputs logical products $\overline{ch0}\cdot ch0$–$\overline{ch63}\cdot ch63$ as stop pulse data.

For example, a fact that a stop pulse data is "1" means to execute the cancellation of the residual pressure wave vibration in the associated ink channel 613. A fact that the stop pulse data is "0" means not to execute the cancellation. A detailed description will be given later of a method of generating stop pulse data and timing for transferring stop pulse data.

In accordance with a transfer data switching signal KS, the electronic switch 46 changes over to one of its nodes A and B. If the switch 46 changes over to the node A, it selects the output from the shift register 42. If the switch 46 changes over to the node B, it selects the output from the AND gate 44. The switch 46 outputs the selected output as transfer data DATA to the drive circuit 211. The output from the node A is ejection pulse data FD for ejecting ink from the channels 613 of the print head 600. The output from the node B is stop pulse data SD.

In accordance with a print timing signal TS transferred from the microcomputer 11, the local control circuit 47 generates signals MS, RDS, SCK1, SCK2 and KS for controlling the circuits 41–43 and 46, a strobe signal STB in synchronism with transfer data DATA, and a print clock ICK. The print timing signal TS may be generated by the microcomputer 11 on the basis of a print command signal given by the user through the control panel 14 or an external signal such as a facsimile signal. In accordance with a rest signal RS transferred from the microcomputer 11, the local control circuit 47 stops generating the signals MS, RDS, SCK1, SCK2, KS, STB and ICK.

Figure 6:
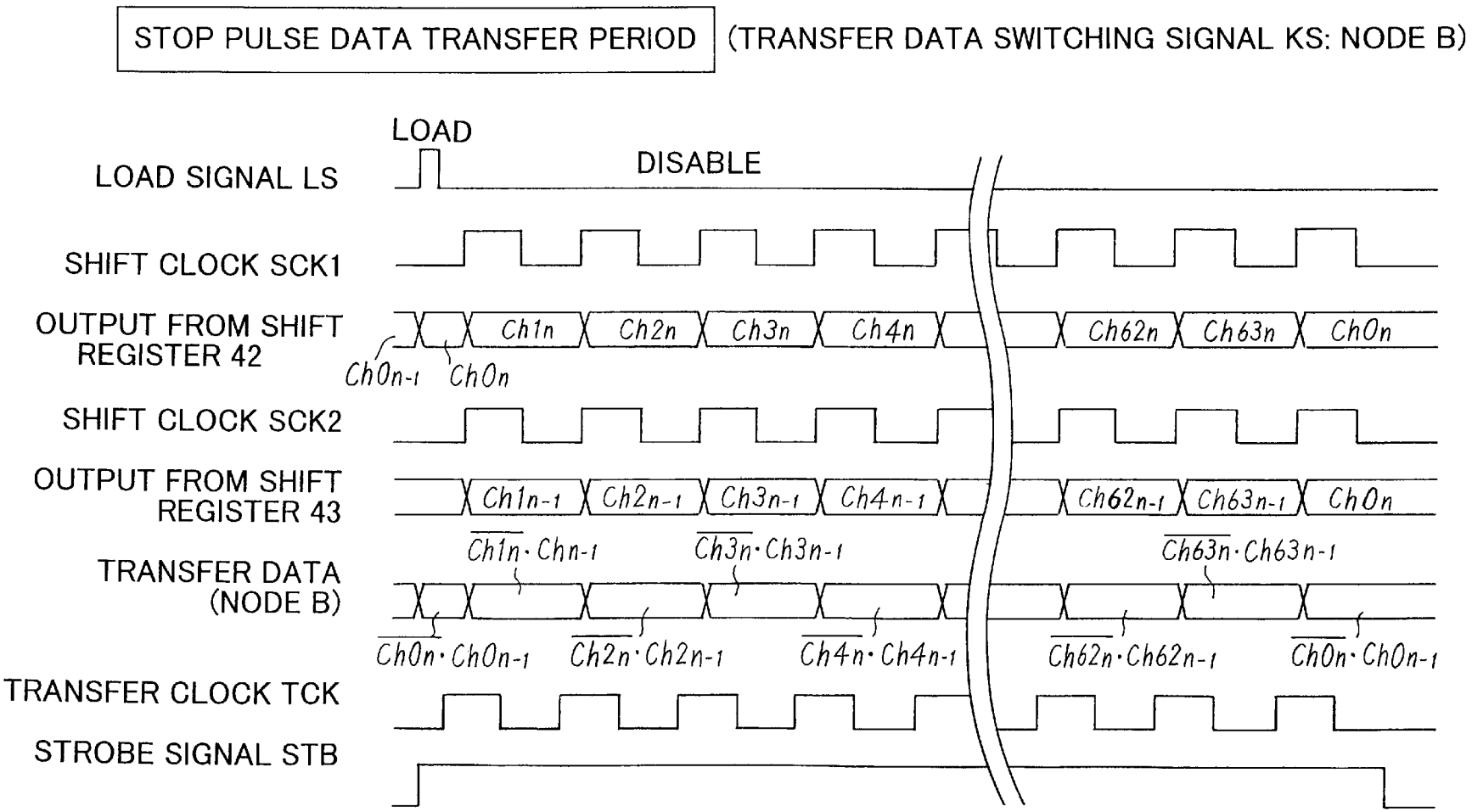
FIG. 6 is another time chart showing the operation of the apparatus according to the first embodiment.
Figure 7:
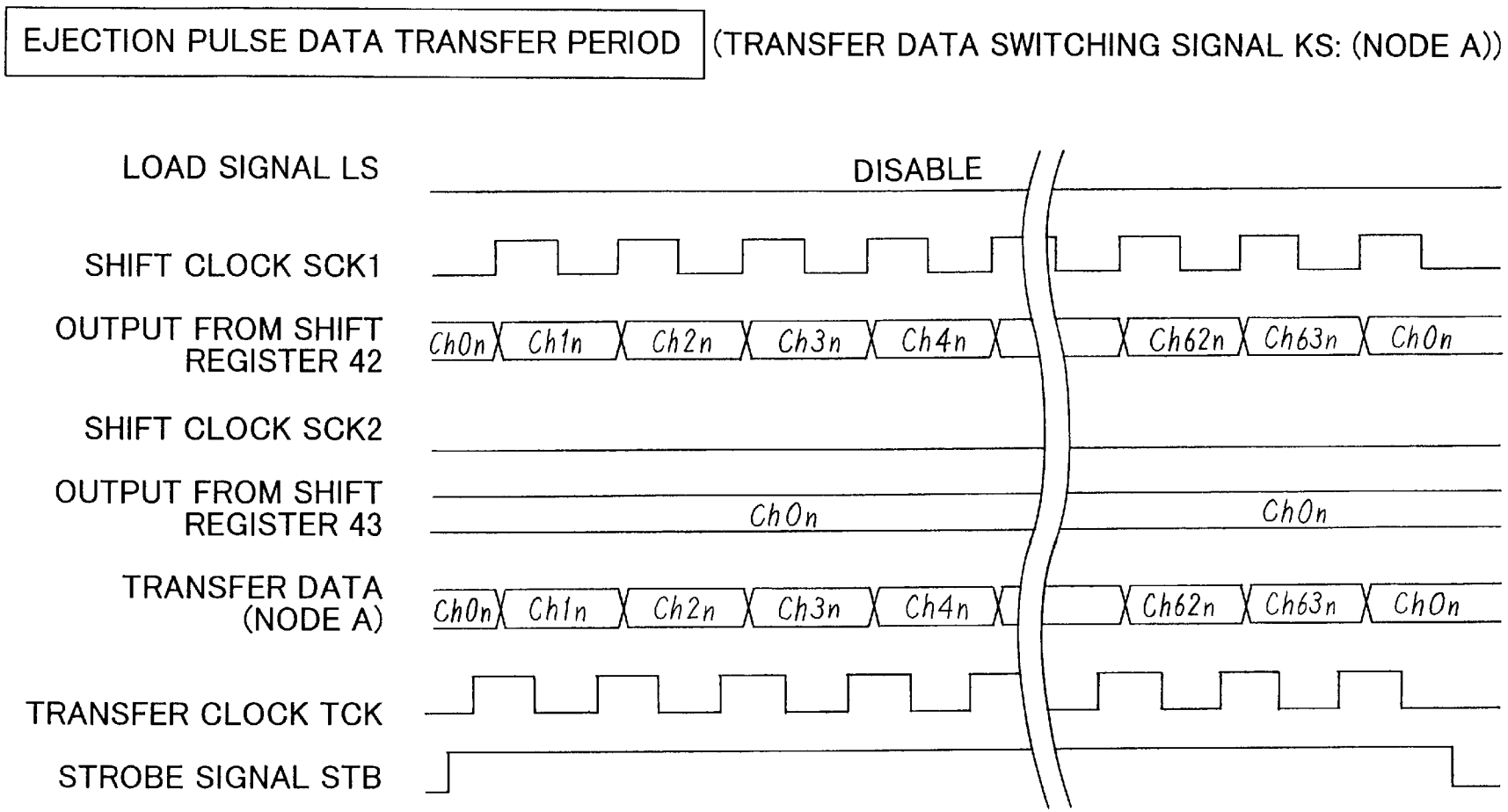
FIG. 7 is still another time chart showing the operation of the apparatus according to the first embodiment.

Referring to FIGS. 6 and 7, the operation of the control circuit 221 will be described. In particular, a description will be given of timing for generating and transferring stop pulse data SDn−1 and ejection pulse data FDn, which correspond to channel data ch0–ch63, and a mechanism for generating the pulse data.

FIG. 6 shows signals in a stop pulse data transfer period, when the electronic switch 46 is switched to the node B. These signals include shift clocks SCK1 and SCK2, outputs from the shift registers 42 and 43, transfer data DATA, a transfer clock TCK and a strobe signal STB. The signals DATA, TCK and STB are transferred from the control circuit 221 to the drive circuit 211.

The local control circuit 47 can synchronously generate shift clocks SCK1 and SCK2.

When a load signal RDS rises, the shift register 42 receives in parallel the image data ch0n–ch63n for the "n"th printing from the data setting circuit 41. When the shift clock pulses SCK1 rise, the register 42 outputs the data ch0n–ch63n serially in that order through its serial output terminal OUT.

When the image data ch0n–ch63n are stored in the shift register 42, the image data ch0n−1–ch63n−1 for the "n−1"th printing are stored in the shift register 43. When the shift clock pulses SCK2 rise, the register 43 outputs the data ch0n−1–ch63n−1 serially in that order through its serial output terminal OUT. At the same time, the serial data ch0n–ch63n output from the register 42 are input to the serial input terminals IN of both registers 42 and 43.

The inverter gate 45 inverts the logical level of the serial image data ch0n–ch63n from the shift register 42. The AND gate 44 receives the inverted serial data ch0n–ch63n from the gate 45 and the serial image data ch0n−1–ch63n−1 from the shift register 43. The AND gate 44 outputs to the node B the logical products of the inverted data $\overline{ch0n}$–$\overline{ch63n}$ and the data ch0n−1–ch63n−1, respectively.

During the stop pulse data transfer period, the electronic switch 46 is switched to the node B in accordance with a transfer data switching signal KS. Therefore, stop pulse data SDn−1 are output as transfer data DATA serially from the node B.

The local control circuit 47 generates a transfer clock TCK in association with the shift clocks SCK1 and SCK2. The transfer data DATA are transferred in synchronism with the transfer clock TCK. During the stop pulse data transfer period, this circuit 47 generates a strobe signal STB which is high in logical level (bit data "1"). The strobe signal STB is used as the trigger for latching the stop pulse data SDn−2. The data SDn−2 are associated with the print cycle preceding the print cycle associated with the stop pulse data SDn−1, which are generated in the period of FIG. 6. The data SDn−2 have been output to the data latch 132. A description will be given later of the timing relationship between the rise of the strobe signal STB and the transfer of the data to be latched.

FIG. 7 shows signals in an ejection pulse data transfer period, when the electronic switch 46 is switched to the node A. This period follows the stop pulse data transfer period of FIG. 6. These signals include shift clocks SCK1 and SCK2, outputs from the shift registers 42 and 43, transfer data DATA, a transfer clock TCK and a strobe signal STB. The signals DATA, TCK and STB are transferred from the control circuit 221 to the drive circuit 211. During this period, the local control circuit 47 generates a shift clock SCK1 and no shift clock SCK2.

When the stop pulse data SDn−1 have just been transferred, the image data ch0n–ch63n are stored in the shift registers 42 and 43. Therefore, when the shift clock pulses SCK1 rise, the register 42 outputs the data ch0n–ch63n serially in that order through its serial output terminal OUT. On the other hand, because no shift clock SCK2 is generated, the data ch0n–ch63n are held in the register 43.

During the ejection pulse data period, the electronic switch 46 is switched to the node A in accordance with a transfer data switching signal KS. Therefore, ejection pulse data FDn are output as transfer data DATA serially from the node A.

The local control circuit 47 generates a transfer clock TCK in association with the shift clock SCK1. The transfer data DATA are transferred in synchronism with the transfer clock TCK. During the ejection pulse data transfer period, this circuit 47 generates a strobe signal STB which is high in logical level. The strobe signal STB is used as the trigger for latching the ejection pulse data FDn−1. The data FDn−1 are associated with the print cycle preceding the print cycle associated with the ejection pulse data FDn, which are generated in the period of FIG. 7. The data FDn−1 have been output to the data latch 132.

As stated above, the control circuit 221 can output the stop pulse data SDn−1 which are the logical products of the image data for the "n−1"th printing and the (logically) inverted image data for the "n"th printing.

The operation of the ink jet apparatus can be controlled with the stop pulse data as follows.

Figure 5:
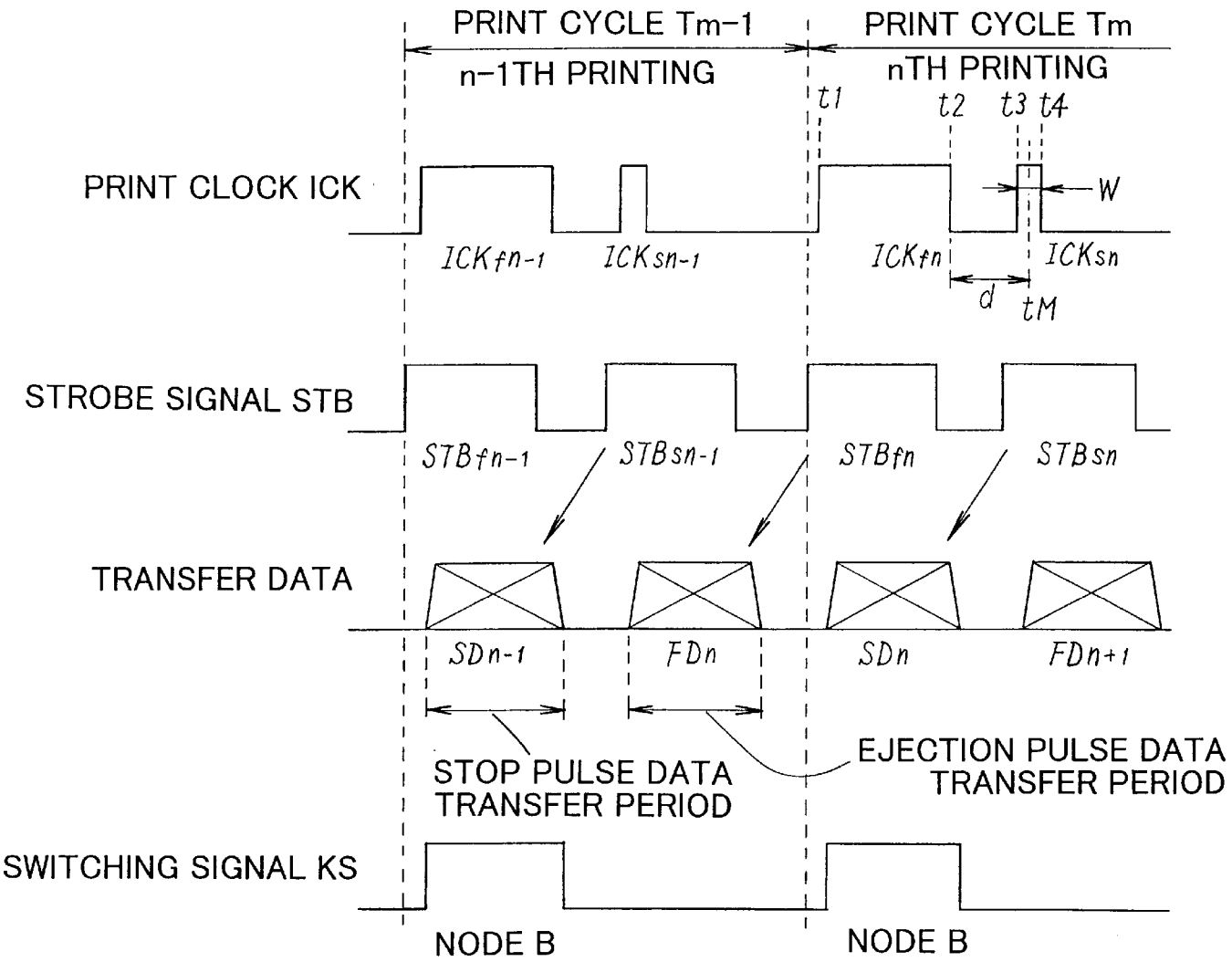
FIG. 5 is a time chart showing the operation of the apparatus according to the first embodiment.

FIG. 5 is a time chart of the print clock ICK, strobe signal STB and transfer data DATA transferred from the control circuit 221 and to the drive circuit 211 during print cycles Tm−1 and Tm. As stated above, the signals STB and ICK and the switching signal KS are generated by the local control circuit 47. The signals STB, ICK and KS each have a cyclic pattern, which is repeated with the print cycles. The "n−1"th print data are transferred in the cycle Tm−1, and the "n"th print data are transferred in the next cycle Tm.

The print clock ICK in each print cycle consists of a pulse ICKf and a pulse ICKs following the pulse ICKf.

In each print cycle, transfer data DATA are transferred from the control circuit 221 to the serial-parallel converter 131 of the drive circuit 211. For example, the data DATA in the cycle Tm−1 consist of 64 stop pulse data SDn−1 and 64 ejection pulse data FDn for the 64 channels. Details of the data SDn−1 and FDn are shown in the time charts of FIGS. 6 and 7.

In the print cycle Tm−1, after the stop pulse data SDn−1 are transferred, the ejection pulse data FDn are transferred next. In the cycle Tm, the stop pulse data SDn for the "n"th printing are followed by the ejection pulse data FDn+1 for the "n+1"th printing. The reason for the data transfer in such order is as follows.

Before the print clock pulse ICKsn−1 is transferred to the drive circuit 211, it is necessary to determine whether the stop pulse data associated with the pulse ICKsn−1 is "1" or "0". Likewise, before the print clock pulse ICKfn is transferred to the drive circuit 211, it is necessary to determine whether the ejection pulse data associated with the pulse ICKfn is "1" or "0".

A strobe signal STB determines the timing for the data latch 132 of the drive circuit 211 to latch data PD0–PD63 sent from the serial-parallel converter 131. Triggered by the rise of a strobe pulse STB, the latch 132 latches data PD0–PD63. Therefore, the generation of strobe pulses STB is so timed that, for example, after the stop pulse data SDn−1 are transferred, the strobe pulse STBsn−1 for latching them rises, and after the ejection pulse data FDn are transferred, the strobe pulse STBfn rises. The strobe signal generation timing has been explained with reference to FIGS. 6 and 7.

Print clock pulses ICKf are associated with ejection pulse data FD. For example, if an ejection pulse data FD for the channel 1 is "1" when a print clock pulse ICKf is generated, the associated AND gate 31 of the drive circuit 211 outputs a drive data which is "1". This drive data causes the associated output circuit 32 to generate a drive voltage.

Likewise, print clock pulses ICKs are associated with stop pulse data SD. For example, if a stop pulse data SD for the channel 1 is "1" when a print clock pulse ICKs is generated, the associated AND gate 31 outputs a drive data which is "1". This drive data causes the associated output circuit 32 to generate a drive voltage. In other words, the print clock ICK functions as an enabling signal for the AND gates 31 to produce drive data A0–A63.

Therefore, as shown in FIG. 5, in the print cycle Tm, when the print clock pulse ICKfn rises at a point of time t1, and if one or more of the parallel data bits are high in logical level or "1", electric fields are generated in the associated actuator walls 603*a*, 603*b*, 603*c*, 603*d*, 603*e*, 603*f*, 603*g*, 603*h* as explained with reference to FIG. 25. The fields enlarge the associated channel or channels 613 in volume, reducing the pressure therein. Then, ink flows into the channel or channels 613. In the meantime, the enlarged volume generates pressure wave vibration. The pressure due to the vibration increases and reverses into positive pressure, which reaches its peak about when the one-way propagation delay time T passes.

The width of the print clock pulse ICKfn equals the one-way propagation delay time T. Therefore, the pulse ICKfn falls at the point t2 when the time T passes. Then, the channel or channels 613 decrease in volume, developing pressure. This pressure and the pressure which has reversed to a plus are added together. This develops relatively high pressure near the nozzle or nozzles 618 in the channel or channels 613, ejecting ink out through the nozzle or nozzles. The ejected ink sticks to the sheet p, forming an image on it.

Thereafter, the print clock pulse ICKsn rises at a point of time t3 before the pressure in the channel or channels 613 reverses from a plus to a minus. This rapidly reduces the pressure which is still positive. The pulse ICKsn falls at a point of time t4 after the pressure reverses to a minus. This rapidly increases the already negative pressure. This, in turn, cancels the pressure wave vibration, rapidly damping it. The cancellation of the pressure wave vibration prevents ink from being ejected accidentally through the nozzle or nozzles 618. This enables the ink jet apparatus to be ready earlier for the step in accordance with the next print command. It is therefore possible to form a more accurate image on the sheet P, and improve the print speed.

The width W of the print clock pulse ICKsn is half (0.5) of the one-way propagation delay time T. As stated above, the pulse ICKsn is what cancels the pressure wave vibration.

Besides, the width W of the pulse ICKsn is short and very different from a value which is an odd number of times as large as the time T. Therefore, the pulse ICKsn causes no ink to be ejected through the nozzle or nozzles 618.

The time "d" between the point t2 and the middle point tM between the points t3 and t4 is 2.5 times as long as the one-way propagation delay time T. Each output circuit 32 generates the same voltage for both ink ejection and vibration cancellation.

If there is a print command for an arbitrary image data chXn−1 out of the data ch0n−1–ch63n−1 for the "n−1"th printing in the cycle Tm−1, the data chXn−1 is high in logical level. If there is no print command for the associated data chXn out of the data ch0n–ch63n for the "n"th printing in the next cycle Tm, the data chXn is low in logical level. In this case, a stop pulse data SDXn−1 high in logical level is produced for the low image data chXn. On the basis of the high stop pulse data SDXn−1, the vibration cancellation in the associated channel 613 is carried out in the cycle Tm−1.

Contrariwise, if the image data chXn is high, a low stop pulse data SDXn−1 is produced for it. On the basis of the low stop pulse data SDXn−1, no vibration cancellation in the channel 613 is carried out in the cycle Tm−1.

It is therefore possible to switch securely between the execution and no execution of such cancellation, depending on whether there is a print command for the print cycle following a certain print cycle. When such selective switching is made, the control circuit 221 can accurately control the voltage application by the drive circuit 211 to the channel electrode or electrodes 619.

The assignee's Japanese Patent Application Laid-Open No.8-258256 discloses a drive circuit which is similar in structure to the drive circuit 211. That is to say, by forming only a control circuit 221 as described above for use with a conventional drive circuit 211, it is possible to provide an ink jet apparatus which can selectively change over between the execution and no execution of the vibration cancellation.

As stated above, part of the print head unit 508 is formed by the print head 600 and the drive circuit 211, which is a one-chip IC. The unit 508 is mounted on the carriage 504. The drive circuit 211 is connected to the control circuit 221 by the harness cable 28.

It is therefore possible to realize this embodiment by using the conventional print head unit 508 in a conventional ink jet printer, and replacing only the control circuit with the circuit 221. This lowers the adapting costs. Consequently, this embodiment makes it possible to cheaply provide an ink jet printer fitted with an ink jet apparatus including a drive circuit 211 and a control circuit 221.

Second Embodiment

Parts of the second embodiment which are identical or equivalent to those of the first are assigned the same reference numerals.

Figure 8:
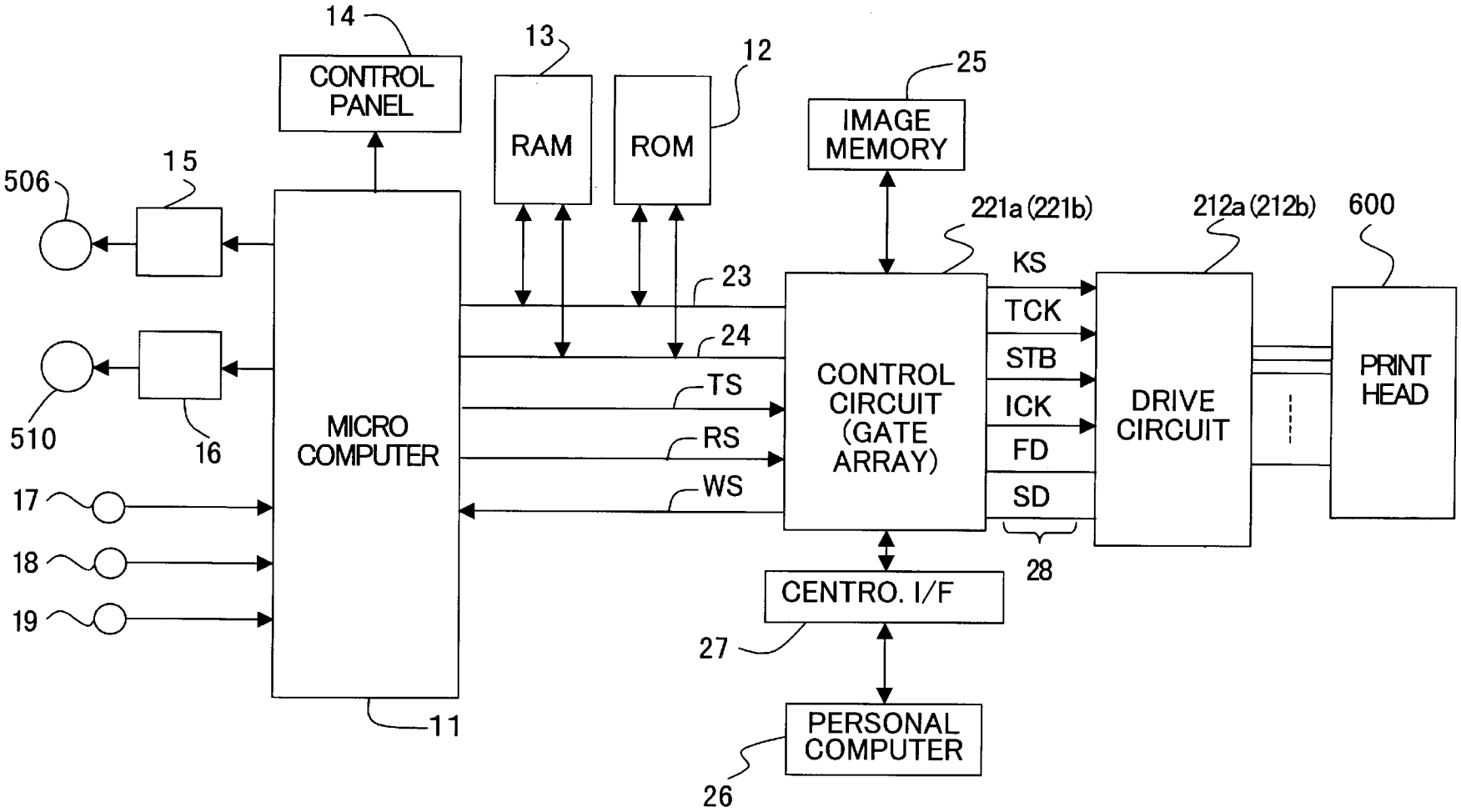
FIG. 8 is a block diagram of the electric system of an ink jet printer including an ink jet apparatus according to a second or a third embodiment of the invention.

Referring to FIG. 8, an ink jet printer has a controller including a one-chip microcomputer 11, a ROM 12 and a RAM 13. The microcomputer 11 is connected to a control panel 14, motor energization circuits 15 and 16, a paper sensor 17, a home position sensor 18, a carriage position sensor 19, etc. The panel 14 can be used for the users' print instructions etc. Referring to FIGS. 8 and 2, the energization circuits 15 and 16 can energize a carriage (CR) motor 506 and a feed (LF) motor 510, respectively. The paper sensor 17 can detect the front end of a sheet of printing paper P as a recording medium. The home position sensor 18 can detect the home position when printing is carried out on a sheet of printing paper P. The carriage position sensor 19 can detect the position of a carriage 504.

The print head 600 can be driven by a drive circuit 212*a*, which is a one-chip IC. The drive circuit 212*a* is controlled by a control circuit 222*a*, which is a gate array. As shown in FIGS. 24A and 24B, the electrodes 619 in the channels 613 of the head 600 are connected to the drive circuit 212. Under the control of the control circuit 222*b*, the drive circuit 212*a* can generate a voltage which is suitable for the head 600, and apply the voltage to the electrodes 619.

The microcomputer 11 is connected to the ROM 12, the RAM 13 and the control circuit 222*b* through an address bus 23 and a data bus 24. In accordance with a program stored in advance in the ROM 12, the microcomputer 11 can generate a print timing signal TS and a reset signal RS, and transfer them to the control circuit 222*b*.

In accordance with a print timing signal TS and a reset signal RS, the control circuit 222*b* generates and transfers to the drive circuit 212*a*:

ejection pulse data FD for ejection of ink through one or more of the nozzles 618 of the print head 600 to form an image on a sheet P on the basis of image data stored in an image memory 25, stop pulse data SD for cancellation of the residual pressure wave vibration in the associated channel or channels 613; a switching signal KS for switching between the data FD and SD; a transfer clock TCK in synchronism with the data FD and SD; a strobe signal STB; and a print clock ICK.

The signals FD, SD, KS, TCK, STB and ICK are transferred through a flexible harness cable 28, which connects the circuits 212*a* and 222*a*.

The control circuit 222*b* causes the image memory 25 to store the image data transferred from a personal computer 26 or other external apparatus through a Centronics interface 27. On the basis of the Centronics data transferred from the computer 26 or the like through the interface 27, the control circuit 222*a* generates a Centronics data receive interrupt signal WS and transfers it to the microcomputer 11.

Figure 9:
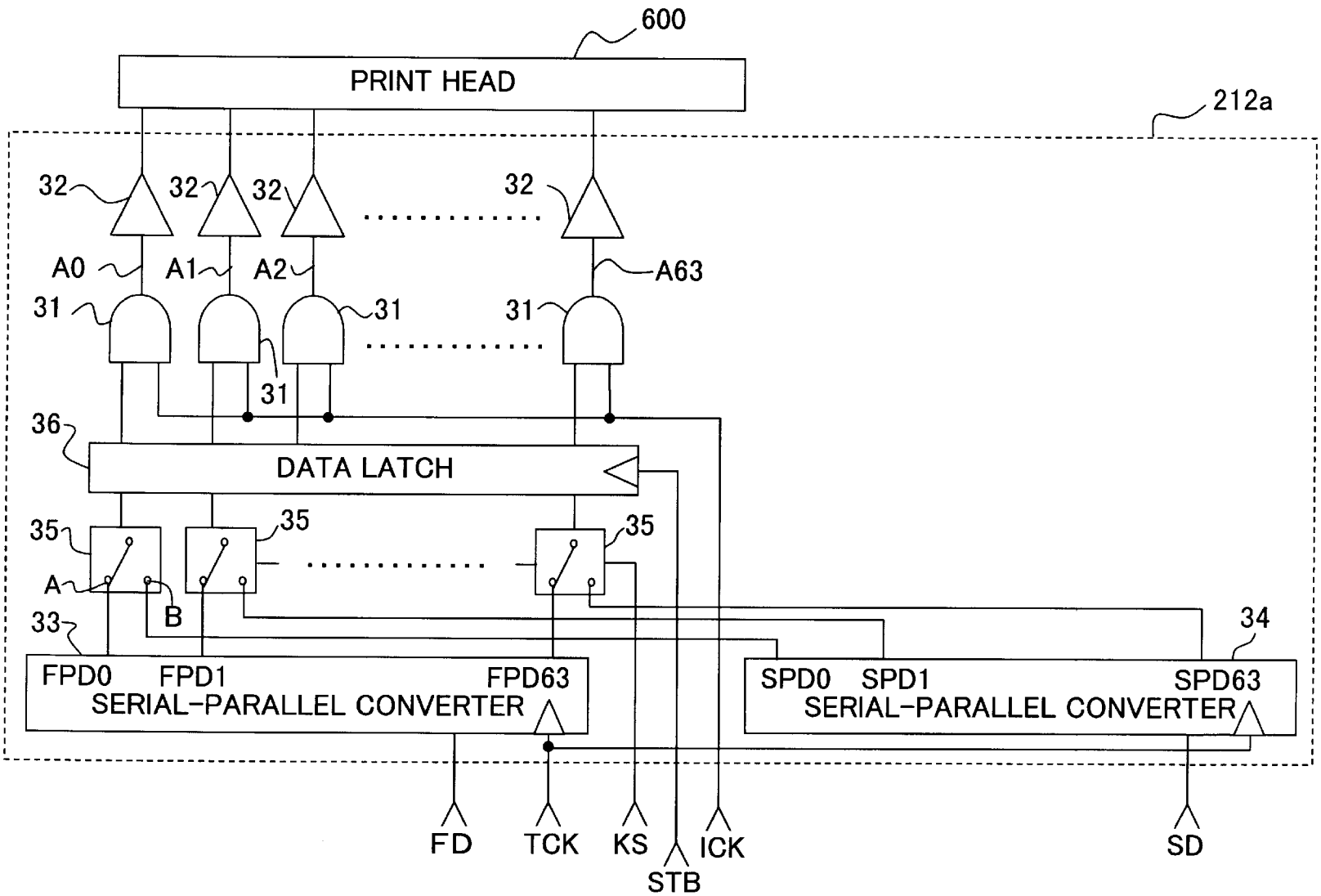
FIG. 9 is a block diagram of the drive circuit of the apparatus according to the second embodiment.

Referring to FIG. 9, the drive circuit 212*a* includes a pair of serial-parallel converters 33 and 34, 64 electronic switches 35, a data latch 36, 64 AND gates 31, and 64 output circuits 32. The converters 33 and 34 are 64-bit shift registers.

The serial-parallel converter 33 receives the ejection pulse data FD transferred serially in synchronism with the transfer clock TCK from the control circuit 222*a*. When the clock pulses TCK rise, the converter 33 converts the serial data FD into parallel data FPD0–FPD63.

The serial-parallel converter 34 receives the stop pulse data SD transferred serially in synchronism with the transfer clock TCK from the control circuit 222*a*. When the clock pulses TCK rise, the converter 34 converts the serial data SD into parallel data SPD0–SPD63.

Each electronic switch 35 has a pair of nodes A and B, and changes over to one of them in accordance with a switching signal KS from the control circuit 222*a*. If the switches 35 change over to the nodes A, they select the parallel data FPD0–FPD63 output from the serial-parallel converter 33. If the switches 35 change over to the nodes B, they select the parallel data SPD0–SPD63 output from the converter 34. The switches 35 output the selected data to the latch 36.

When a strobe signal STB from the control circuit 222*a* rises, the latch 36 latches the parallel data FPD0–FPD63 or SPD0–SPD63, and outputs the latched data to the AND gates 31.

The AND gates 31 output drive data A0–A63 as the logical products of the parallel data FPD0–FPD63 or SPD0–SPD63 and the print clock pulses ICK from the control circuit 222*a* together. The drive data A0–A63 are associated with the parallel data FPD0–FPD63 or SPD0–SPD63, respectively.

On the basis of the drive data A0–A63, the output circuits 32 can generate a voltage which is suitable for the print head 600. Each circuit 32 can output the voltage to one of the channel electrodes 619 of the head 600.

If the print head 600 did not have 64 channels, it would only be necessary for the output circuits 32, the AND gates 31, the electronic switches 35, and the bits of each of the serial-parallel converters 33 and 34 to be equal in number to the channels.

Figure 10:
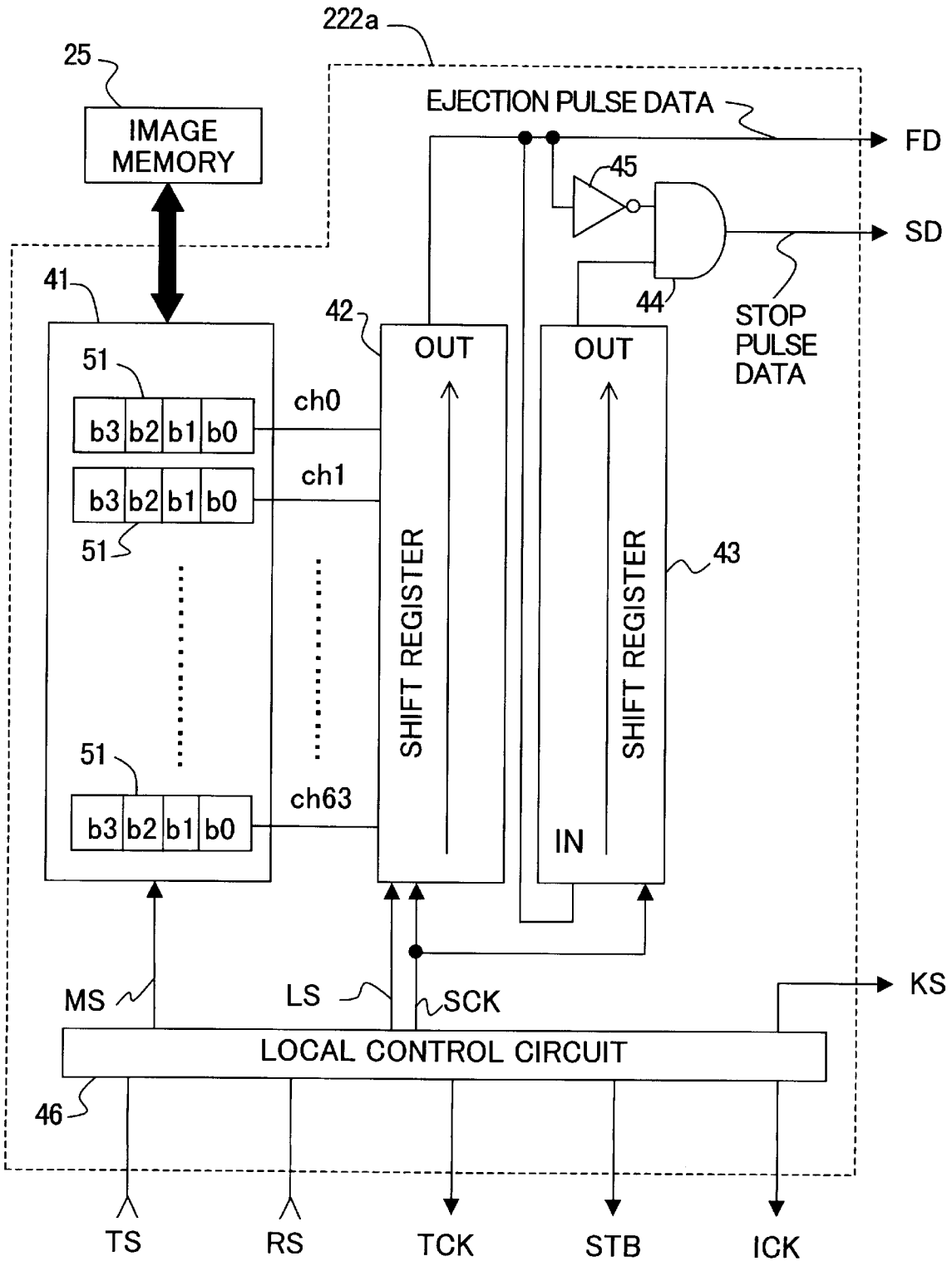
FIG. 10 is a block diagram of the control circuit of the apparatus according to the second embodiment.

Referring to FIG. 10, the control circuit 222*a* includes a local control circuit 46, a data setting circuit 41, a pair of 64-bit shift registers 42 and 43, an inverter gate 45, and an AND gate 44. The setting circuit 41 includes 64 4-bit shift registers 51.

The data setting circuit 41 reads out in parallel the image data stored in the image memory 25, and stores 4 bits of the parallel image data in each shift register 51. In accordance with a set command signal MS, the image data stored in the minimum bits b0 of the shift registers 51 are transferred to the shift register 42. Then, the registers 51 shift the data in them by one bit toward their minimum bits b0, emptying their maximum bits b3. Four times of the transfer to the register 42 empty all the bits of the registers 51. Then, image data are transferred again from the memory 25 to the registers 51.

Every time a load signal RDS rises, the shift register 42 receives image data ch0–ch63 from the channels of the data setting circuit 41 in parallel. When shift clock pulses SCK rise, the register 42 outputs the data ch0–ch63 serially in that order, by one bit at a time, through its serial output terminal OUT. This makes a parallel-serial conversion of image data. The serial data output from the register 42 are transferred as ejection pulse data FD to the drive circuit 212*a*.

The shift register 43 receives serially the image data ch0–ch63 output serially from the register 42. When the shift clock pulses SCK rise, this register 43 outputs the data ch0–ch63 serially in that order through its serial output terminal OUT.

The AND gate 44 receives the serial image data ch0–ch63 from the shift register 42 through the inverter gate 45 and the serial image data ch0–ch63 from the register 43. The AND gate 44 outputs logical products as stop pulse data SD, which are transferred to the drive circuit 212*a*.

In accordance with a print timing signal TS transferred from the microcomputer 11, the local control circuit 46 generates signals MS, RDS and SCK for controlling the circuits 41–43, a switching signal KS for controlling the electronic switches 35 of the drive circuit 212*a*, a strobe signal STB in synchronism with the data FD and SD, and the print clock ICK. In accordance with a rest signal RS transferred from the microcomputer 11, the local control circuit 46 stops generating the signals MS, RDS, SCK, KS, STB and ICK.

If the print head 600 did not have 64 channels, it would only be necessary for the bits of each of the shift registers 51, 42 and 43 to be equal in number to the head channels.

Each channel 613 of the print head 600 is associated with one of the parallel data FPD0–FPD63 from the serial-parallel converter 33 of the drive circuit 212*a* and one of the parallel data SPD0–SPD63 from the converter 34. Therefore, each channel 613 is associated with one bit of the data FD, one bit of the data SD, and one of the image data ch0–ch63 in the control circuit 222*a*. In other words, in accordance with each bit of the data FD, each bit of the data SD and each of the data ch0–ch63, the voltage to be applied to the associated channel electrode 619 is generated, and the ink ejection through the associated nozzle 618 is controlled during the ejection and the vibration cancellation.

The operation of the ink jet apparatus will be explained below.

Figure 11:
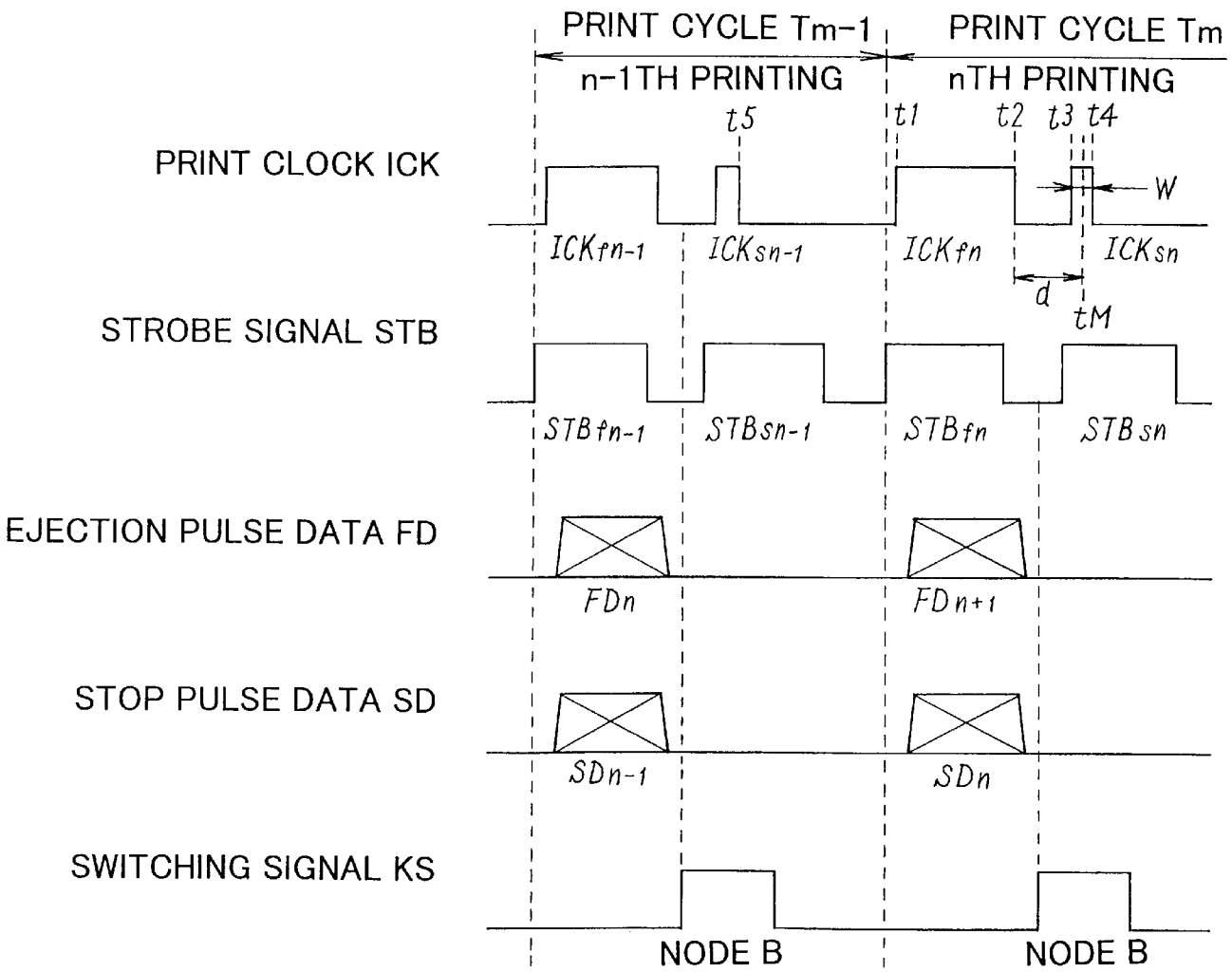
FIG. 11 is a time chart showing the operation of the apparatus according to the second embodiment.

In each print cycle, the ink ejection is followed by the vibration cancellation. Referring to FIG. 11, the "n−1"th printing may be carried out in a print cycle Tm−1, and the "n"th printing may be carried out in the next cycle Tm. In this case, the print clock ICK consists of a pulse ICKf transferred for the ejection pulse data FD and a pulse ICKs transferred for the stop pulse data SD in each of the cycles Tm−1 and Tm. The pulse ICKf is followed by the pulse ICKs.

In the cycle Tm−1, the ejection pulse data FDn for the "n"th printing and the stop pulse data SDn−1 for the "n−1"th printing are transferred at the same time. In the cycle Tm, the ejection pulse data FDn+1 for the "n+1"th printing and the stop pulse data SDn for the "n"th printing are transferred at the same time.

In the cycle Tm−1, the strobe signal STB consists of a pulse STBfn−1 transferred for the ejection pulse data FDn−1 (not shown) for the "n−1"th printing and a pulse STBsn−1 transferred for the stop pulse data SDn−1 for the "n−1"th printing. The pulse STBfn−1 is followed by the pulse STBsn−1. In the cycle Tm, the strobe signal STB consists of a pulse STBfn transferred for the ejection pulse data FDn for the "n"th printing and a pulse STBsn transferred for the stop pulse data SDn for the "n"th printing. The pulse STBfn is followed by the pulse STBsn.

The switching signal KS is transferred in association with the strobe signal STB.

Specifically, in the cycle Tm−1, the print clock ICK consists of a pulse ICKfn−1 transferred for the ejection pulse data FDn−1 for the "n−1"th printing and a pulse ICKsn−1 transferred for the stop pulse data SDn−1 for the "n−1"th printing. The pulse ICKfn−1 is followed by the pulse ICKsn−1. In the cycle Tm, the print clock ICK consists of a pulse ICKfn transferred for the ejection pulse data FDn for the "n"th printing and a pulse ICKsn transferred for the stop pulse data SDn for the "n"th printing. The pulse ICKfn is followed by the pulse ICKsn.

Referring to FIG. 11, the operation of the drive circuit 212*a* will be explained.

In each of the cycles Tm−1 and Tm, if the strobe signal STBsn−1 and STBsn for the stop pulse data SDn−1 and SDn are transferred, the switching signals KS switch the electronic switches 35 of the drive circuit 212*a* to the nodes B. Otherwise, in each of the cycles Tm−1 and Tm, the signals KS switch the switches 35 to the nodes A.

If the switches 35 are switched to the nodes A, the data latch 36 of the drive circuit 212*a* latches the parallel ejection pulse data FPD0–FPD63 output from the serial-parallel converter 33. If the switches 35 are switched to the nodes B, the latch 36 latches the parallel stop pulse data SPD0–SPD63 from the converter 34.

If the print clock ICK is high in logical level, the output from each AND gate 31 of the drive circuit 212*a* depends on the output from the data latch 36. If the print clock ICK is low in logical level, the output from each AND gate 31 is low in logical level regardless of the output from the latch 36. In other words, the clock ICK functions as an enabling signal for the AND gates 31 to produce drive data A0–A63.

If the print clock ICK is high in logical level, and if each of the parallel data FPD0–FPD63 or SPD0–SPD63 from the data latch 36 is high in logical level, the associated AND gate 31 outputs a drive data which is high in logical level.

The associated output circuit 32 generates a voltage and outputs it to the associated channel electrode 619 of the print head 600. If the print clock ICK is low in logical level, and even if each of the parallel data FPD0–FPD63 or SPD0–SPD63 from the latch 36 is high in logical level, the associated AND gate 31 outputs a drive data which is low in logical level. The associated output circuit 32 generates no voltage.

Therefore, in the print cycle Tm, as shown in FIG. 11, if one or more of the parallel ejection pulse data FPD0–FPD63 are high in logical level, and when the print clock pulse ICKfn rises at a point of time t1, electric fields are generated in the associated actuator walls 603*a*, 603*b*, 603*c*, 603*d*, 603*e*, 603*f*, 603*g*, 603*h* as explained with reference to FIG. 25. The fields enlarge the associated channel or channels 613 in volume, reducing the pressure therein. Then, ink flows into the channel or channels 613. In the meantime, the enlarged volume generates pressure wave vibration. The pressure due to the vibration increases and reverses into positive pressure, which reaches its peak about when the one-way propagation delay time T passes.

The width of the print clock pulse ICKfn equals the one-way propagation delay time T. Therefore, the pulse ICKfn falls at the point t2 when the time T passes. Then, the channel or channels 613 decrease in volume, developing pressure. This pressure and the pressure which has reversed to a plus are added together. This develops relatively high pressure near the nozzle or nozzles 618 in the channel or channels 613, ejecting ink out through the nozzle or nozzles. The ejected ink sticks to the sheet P, forming an image on it.

Thereafter, the print clock pulse ICKsn rises at a point of time t3 before the pressure in the channel or channels 613 reverses from a plus to a minus. This rapidly reduces the pressure which is still positive. The pulse ICKsn falls at a point of time t4 after the pressure reverses to a minus. This rapidly increases the already negative pressure. This, in turn, cancels the pressure wave vibration, rapidly damping it. The cancellation of the pressure wave vibration prevents ink from being ejected accidentally through the nozzle or nozzles 618. This enables the ink jet apparatus to be ready earlier for the step in accordance with the next print command. It is therefore possible to form a more accurate image on the sheet P, and improve the print speed.

The width W of the print clock pulse ICKsn is half (0.5) of the one-way propagation delay time T. As stated above, the pulse ICKsn is what cancels the pressure wave vibration. Besides, the width W of the pulse ICKsn is short and very different from a value which is an odd number of times as large as the time T. Therefore, the pulse ICKsn causes no ink to be ejected through the nozzle or nozzles 618.

The time "d" between the point t2 and the middle point tM between the points t3 and t4 is 2.5 times as long as the one-way propagation delay time T. Each output circuit 32 generates the same voltage for both ink ejection and vibration cancellation.

Figure 12:
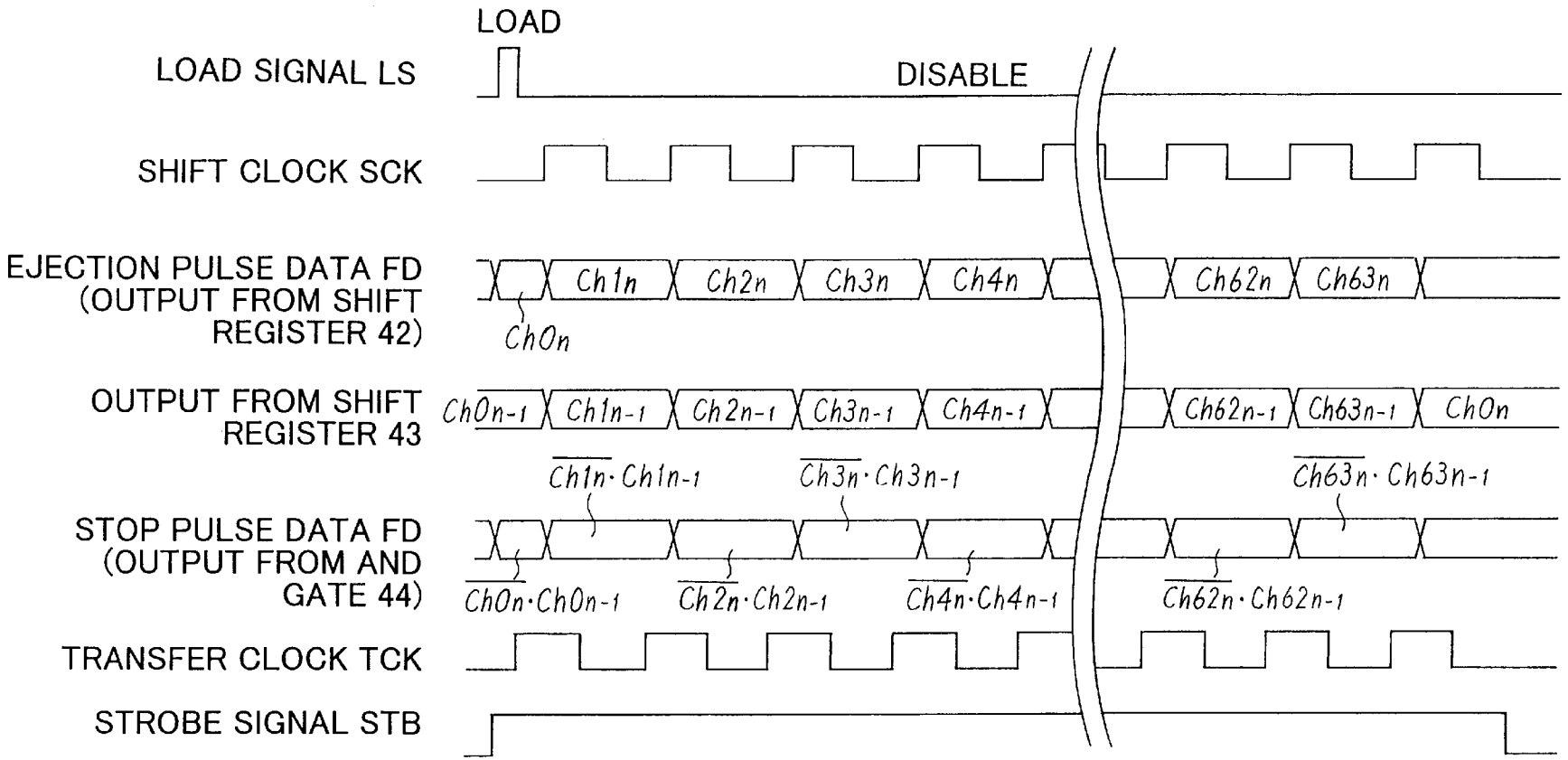
FIG. 12 is another time chart showing the operation of the apparatus according to the second embodiment.

FIG. 12 is a time chart showing the operation of the control circuit 222*a* in the print cycle Tm−1. When a load signal RDS rises, the shift register 42 receives the image data ch0n–ch63n for the "n"th printing in parallel from the data setting circuit 41. When the shift clock pulses SCK rise, the register 42 outputs the data ch0n–ch63n serially in that order through its serial output terminal OUT. The serial data output from the register 42 are transferred as the ejection pulse data FDn to the drive circuit 212*a*.

When the image data ch0n–ch63n are stored in the shift register 42, the image data ch0n−1–ch63n−1 for the "n−1"th printing are stored in the shift register 43. When the shift clock pulses SCK rise, the register 43 outputs the data ch0n−1–ch63n−1 serially in that order through its serial output terminal OUT.

The inverter gate 45 inverts the logical level of the serial image data ch0n–ch63n from the shift register 42. The AND gate 44 receives the inverted serial data ch0n–ch63n from the gate 45 and the serial image data ch0n−1–ch63n−1 from the shift register 43. The AND gate 44 outputs the logical products of the inverted data ch0n–ch63n and the data ch0n−1–ch63n−1, respectively. The output from the AND gate 44 is transferred as the stop pulse data SDn−1 to the drive circuit 212*a*.

The local control circuit 46 generates the transfer clock TCK in association with the shift clock SCK. Therefore, the ejection pulse data FDn and the stop pulse data SDn−1 are transferred in synchronism with the transfer clock TCK. While the data FDn and SDn−1 are transferred, this circuit 46 generates a strobe signal STB which is high or a bit data "1" in logical level.

The shift register 43 receives through its serial input terminal IN the serial image data ch0n–ch63n from the shift register 42. Therefore, when the transfer of the ejection pulse data FDn and the stop pulse data SDn−1 for the cycle Tm−1 is finished, the image data ch0n–ch63n for producing the stop pulse data SDn are stored in the register 43. This makes the control circuit 222*a* ready for the production of the data FDn+1 and SDn for the next cycle Tm.

As stated hereinbefore in detail, the stop pulse data SDn−1 output from the control circuit 222*a* are the logical products of the image data for the "n"th printing which are inverted in logical level and the image data for the "n−1"th printing.

If there is a print command for an arbitrary image data chXn−1 out of the data ch0n−1–ch63n−1 for the "n−1"th printing in the cycle Tm−1, the data chXn−1 is high or a bit data "1" in logical level. If there is no print command for the associated data chXn out of the data ch0n–ch63n for the "n"th printing in the next cycle Tm, the data chXn is low or a bit data "0" in logical level. In this case, a stop pulse data SDXn−1 high in logical level is produced for the low image data chXn. On the basis of the high stop pulse data SDXn−1, the vibration cancellation in the associated channel 613 is carried out in the cycle Tm−1.

Contrariwise, if the image data chXn is high, a low stop pulse data SDXn−1 is produced for it. On the basis of the low stop pulse data SDXn−1, no vibration cancellation in the channel 613 is carried out in the cycle Tm−1.

It is therefore possible to switch securely between the execution and no execution of such cancellation, depending on whether there is a print command for the print cycle following a certain print cycle. When such selective switching is made, the control circuit 222*a* can accurately control the voltage application by the drive circuit 212*a* to the channel electrode or electrodes 619.

The control circuit 222*a* simultaneously produces the ejection pulse data FDn for the "n"th printing and the stop pulse data SDn−1 for the "n−1"th printing. The data FDn and SDn−1 are transferred simultaneously to the drive circuit 212*a*. The serial-parallel converters 33 and 34 convert the serial data FDn and SDn−1 simultaneously into the parallel data FPD0–FPD63 and SPD0–SPD63. In accordance with a switching signal KS, the electronic switches 35 change over to output either the parallel data FPD0–FPD63 or the parallel data SPD0–SPD63 to the data latch 36. In accordance with a strobe signal STB, the latch 36 latches the data output from the switches 35.

Therefore, as shown in FIG. 11, it is possible to shorten the time interval between the point t5 when the print clock pulse ICKsn−1 for the stop pulse data SDn−1 falls and the point t1 when the print clock pulse ICKfn for the ejection pulse data FDn rises. This makes it possible to shorten the period of the cycles Tm−1 and Tm, improving the print speed.

Third Embodiment

Parts of the third embodiment which are identical or equivalent to those of the second are assigned the same reference numerals, and the description of them will be omitted.

Figure 13:
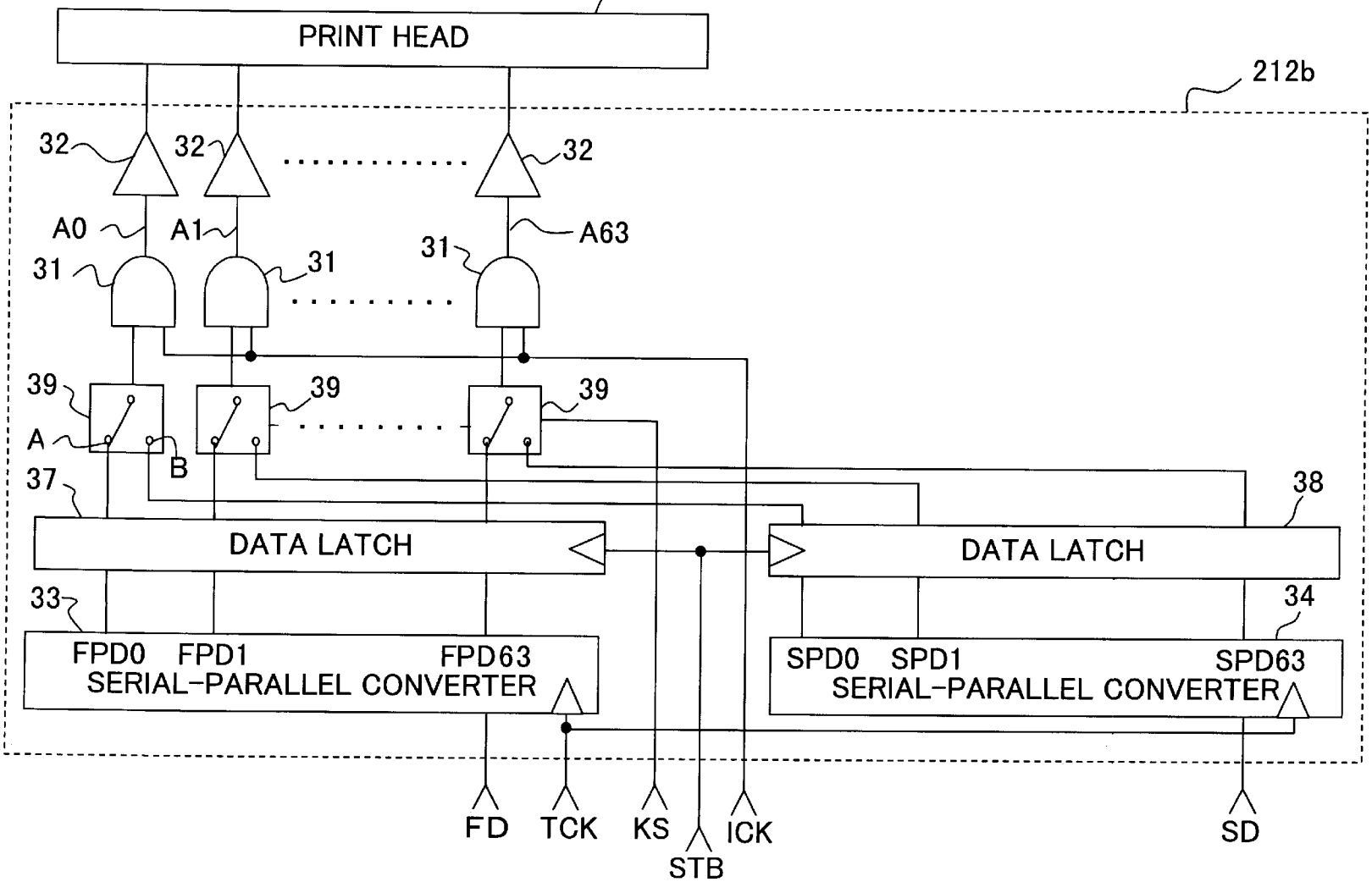
FIG. 13 is a block diagram of the drive circuit of the apparatus according to the third embodiment.

FIG. 13 shows a drive circuit 212*b* according to this embodiment. This circuit 212*b* includes a pair of serial-parallel converters 33 and 34, a pair of data latches 37 and 38, 64 electronic switches 39, 64 AND gates 31, and 64 output circuits 32.

When a strobe signal STB transferred from a control circuit 222*b* (FIG. 14) rises, the data latches 37 and 38 latch the parallel data FPD0–FPD63 and SPD0–SPD63 output from the serial-parallel converters 33 and 34, respectively.

In accordance with a switching signal KS transferred from the control circuit 222*b*, the electronic switches 39 change over to either their nodes A or their nodes B. If the switches 39 change over to the nodes A, they select the parallel data FPD0–FPD63 output from the data latch 37. If the switches 39 change over to the nodes B, they select the parallel data SPD0–SPD63 output from the latch 38. The switches 39 output the selected data to the AND gates 31.

In short, the drive circuit 212*b* of this embodiment differs from the counterpart of FIG. 9 in that the parallel data from the converters 33 and 34 of this embodiment are latched by the latches 37 and 38, respectively, and the data from one of the latches are selected by the switches 39 and then sent to the AND gates 31.

Figure 14:
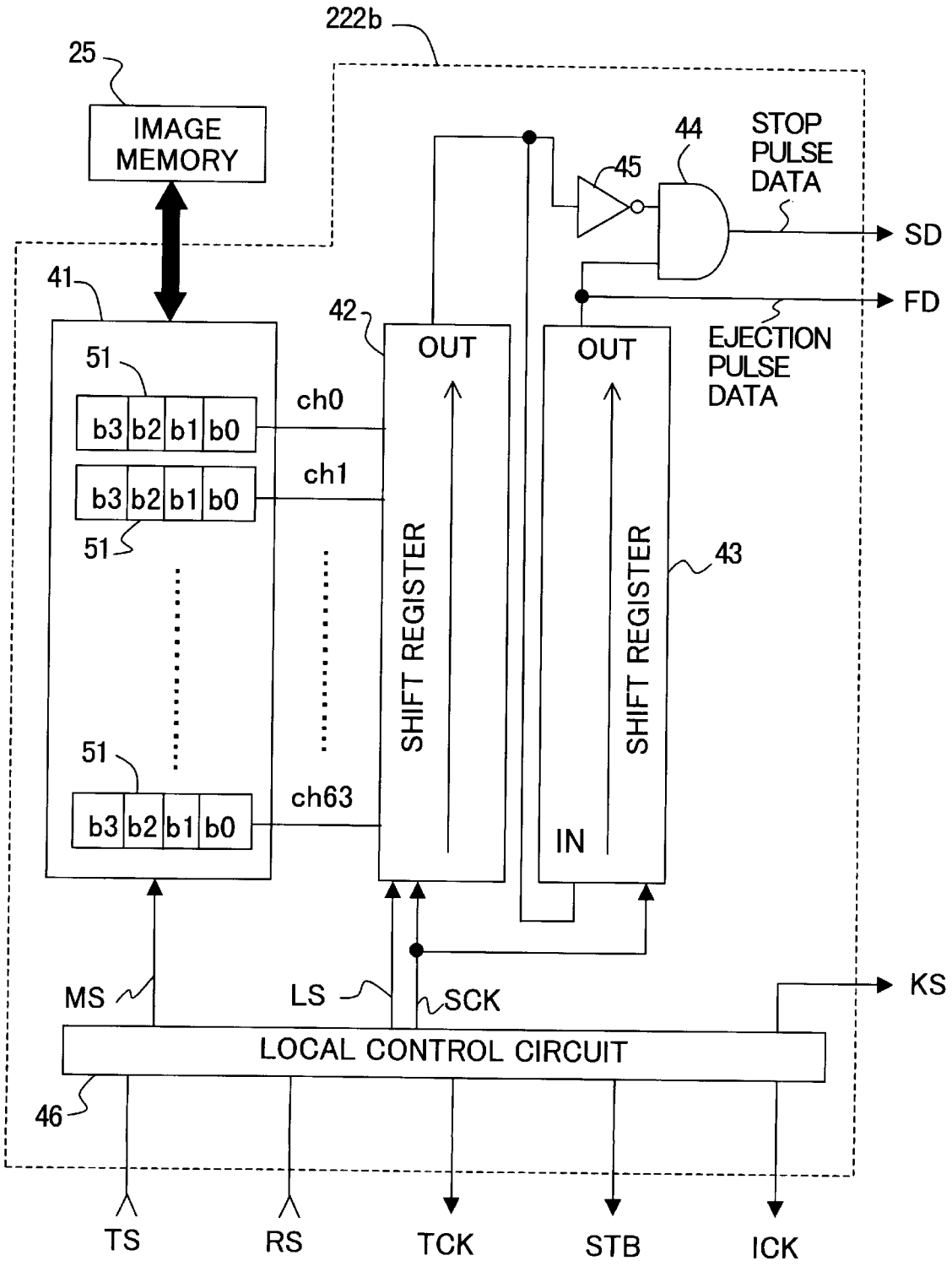
FIG. 14 is a block diagram of the control circuit of the apparatus according to the third embodiment.

As shown in FIG. 14, the control circuit 222*b* of this embodiment differs from the counterpart of FIG. 10 in that the serial data output from the shift register 43, not 42, are transferred as ejection pulse data FD to the drive circuit 212*b*.

The ink jet apparatus according to this embodiment will be explained below.

Figure 15:
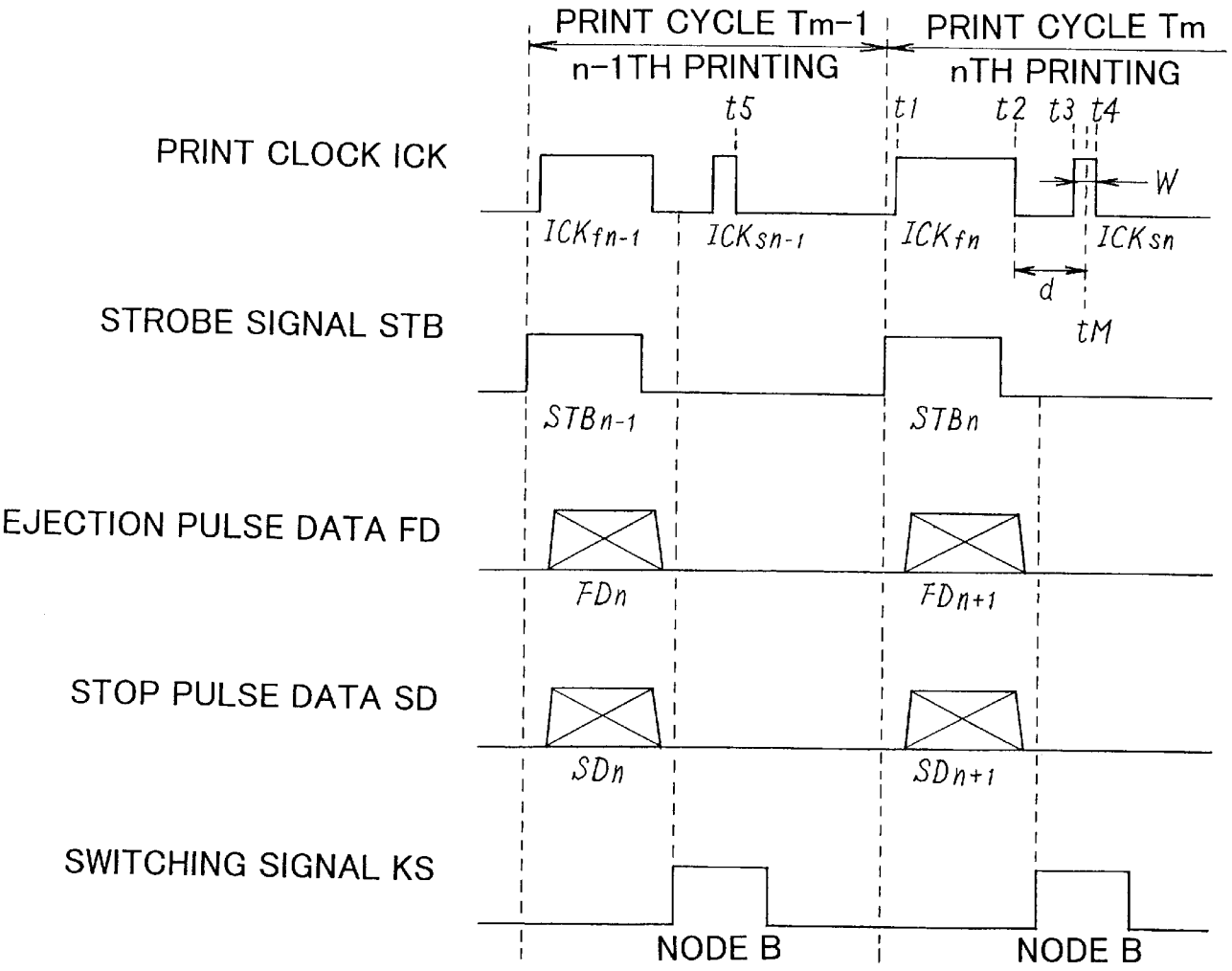
FIG. 15 is a time chart showing the operation of the apparatus according to the third embodiment.

Referring to FIG. 15, the ejection pulse data FDn for the "n"th printing and the stop pulse data SDn for the "n"th printing are transferred at the same time in a print cycle Tm−1. In the next cycle Tm, the ejection pulse data FDn+1 for the "n+1"th printing and the stop pulse data SDn+1 for the "n+1"th printing are transferred to the drive circuit 212*b* at the same time.

In the cycle Tm−1, a pulse STBn−1 of the strobe signal STB is transferred for the ejection pulse data FDn−1 (not shown) and the stop pulse data SDn−1 (not shown) for the "n−1"th printing. In the next cycle Tm, a pulse STBn of the strobe signal STB is transferred for the ejection pulse data FDn and the stop pulse data SDn for the "n"th printing.

The switching signal KS is transferred in synchronism with a print clock ICK.

Referring to FIG. 15, the operation of the drive circuit 212*b* will be explained.

In each of the cycles Tm−1 and Tm, the electronic switches 39 are switched to the nodes B in accordance with the switching signal KS when the print clock pulses ICKsn−1 and ICKsn associated with the stop pulse data SDn−1 and SDn, respectively, are transferred. Otherwise, in each of the cycles Tm−1 and Tm, the switches 39 are switched to the nodes A in accordance with the switching signal KS.

If the electronic switches 39 are switched to the nodes A, the AND gates 31 receive the parallel ejection pulse data FPD0–FPD63 output from the serial-parallel converter 33 and latched by the data latch 37. If the switches 39 are switched to the nodes B, the gates 31 receive the parallel stop pulse data SPD0–SPD63 output from the converter 34 and latched by the latch 38.

If the print clock ICK is high in logical level, the output from each AND gate 31 depends on the output from the associated electronic switch 39. If the print clock ICK is low in logical level, the output from each AND gate 31 is low in logical level regardless of the output from the associated switch 39. In other words, the clock ICK functions as an enabling signal for the AND gates 31 to produce drive data A0–A63.

If the print clock ICK is high in logical level, and if each of the parallel data FPD0–FPD63 or SPD0–SPD63 from the electronic switches 39 is high in logical level, the associated AND gate 31 outputs a drive data which is high in logical level. The associated output circuit 32 generates a voltage and outputs it to the associated channel electrode 619 of the print head 600. If the print clock ICK is low in logical level, and even if each of the parallel data FPD0–FPD63 or SPD0–SPD63 from the switches 39 is high in logical level, the associated AND gate 31 outputs a drive data which is low in logical level. The associated output circuit 32 generates no voltage.

The ink ejection and the vibration cancellation between the points of time t1 and t4 are identical to those of the second embodiment.

Figure 16:
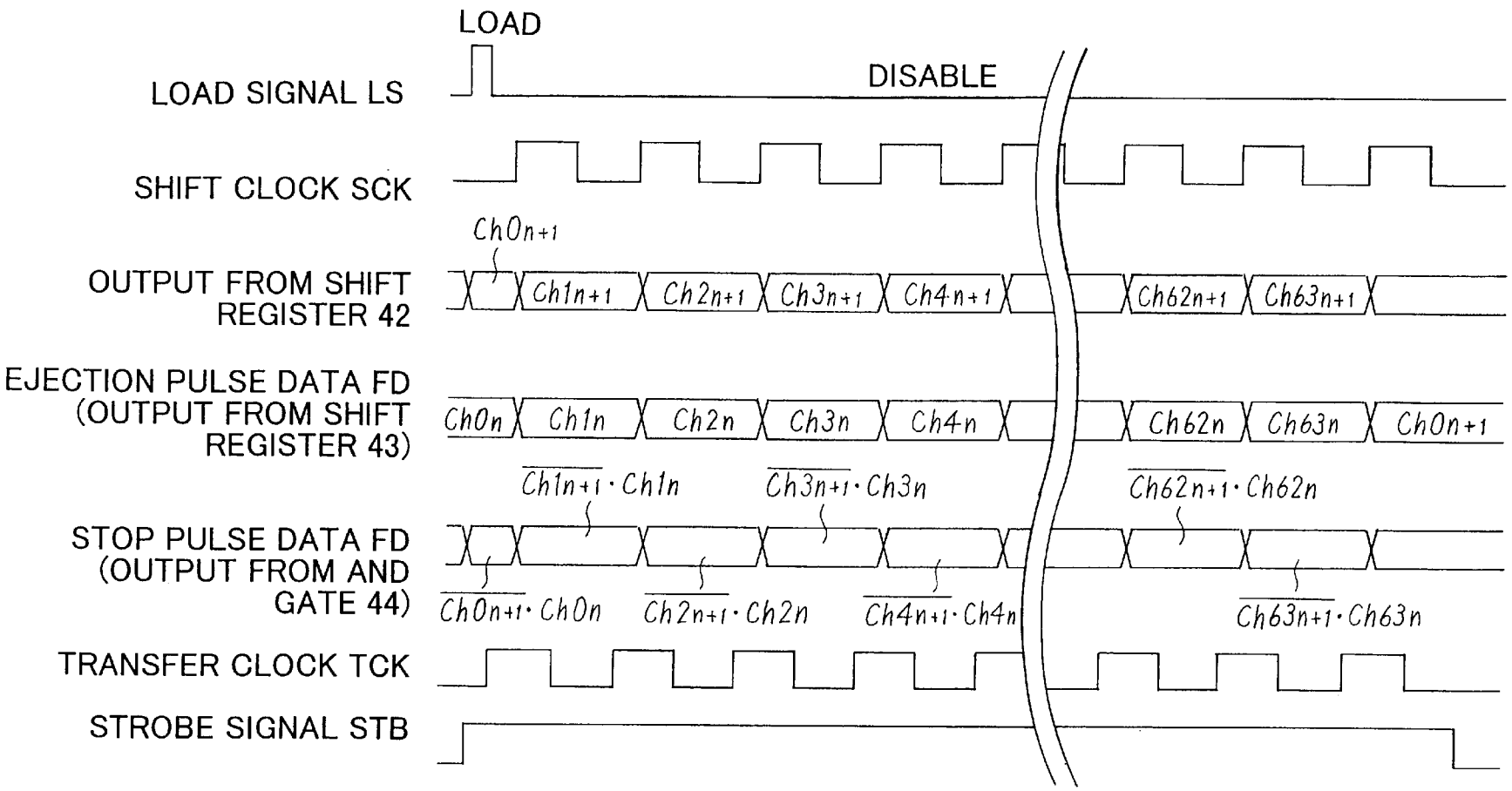
FIG. 16 is another time chart showing the operation of the apparatus according to the third embodiment.

FIG. 16 is a time chart showing the operation of the control circuit 222*b* in the print cycle Tm−1.

When a load signal RDS rises, the shift register 42 receives the image data ch0n+1–ch63n+1 for the "n+1"th printing in parallel from the data setting circuit 41. When the shift clock pulses SCK rise, the register 42 outputs the data ch0n+1–ch63n+1 serially in that order through its serial output terminal OUT.

When the image data ch0n+1–ch63n+1 are stored in the shift register 42, the image data ch0n–ch63n for the "n"th printing are stored in the shift register 43. When the shift clock pulses SCK rise, the register 43 outputs the data ch0n–ch63n serially in that order through its serial output terminal OUT. The serial data output from the register 43 are transferred as the ejection pulse data FDn to the drive circuit 212*b*.

The inverter gate 45 inverts the logical level of the serial image data ch0n+1–ch63n+1 from the shift register 42. The AND gate 44 receives the inverted serial data ch0n+1–ch63n+1 from the gate 45 and the serial image data ch0n–ch63n from the shift register 43. The AND gate 44 outputs the logical products of the inverted data ch0n+1–ch63n+1 and the data ch0n–ch63n, respectively. The output from the AND gate 44 is transferred as the stop pulse data SDn to the drive circuit 212*b*.

The local control circuit 46 generates a transfer clock TCK in association with the shift clock SCK. Therefore, the ejection pulse data FDn and the stop pulse data SDn are transferred in synchronism with the transfer clock TCK to the serial-parallel converter 33 and 34, respectively. While the data FDn and SDn are transferred, this circuit 46 generates a strobe signal STB which is high in logical level.

The shift register 43 receives through its serial input terminal IN the serial image data ch0n+1–ch63n+1 from the shift register 42. Therefore, when the transfer of the ejection pulse data FDn and the stop pulse data SDn for the cycle Tm−1 is finished, the image data ch0n+1–ch63n+1 for producing the stop pulse data SDn+1 are stored in the register 43. This makes the control circuit 222*b* ready for the production of the data FDn+1 and SDn+1 for the next cycle Tm.

As stated above in detail, the stop pulse data SDn output from the control circuit 222*b* are the logical products of the image data for the "n+1"th printing which are inverted in logical level and the image data for the "n"th printing. Therefore, as is the case with the second embodiment, it is possible to switch securely between the execution and no execution of the vibration cancellation, depending on whether there is a print command for the print cycle following a certain print cycle.

The control circuit 222*b* simultaneously produces the ejection pulse data FDn for the "n"th printing and the stop pulse data SDn for the "n"th printing. The data FDn and SDn are transferred simultaneously to the drive circuit 212*b*. The serial-parallel converters 33 and 34 convert the serial data FDn and SDn simultaneously into the parallel data FPD0–FPD63 and SPD0–SPD63. The parallel data FPD0–FPD63 and SPD0–SPD63 are output to the data latches 37 and 38, respectively, where they are latched at the same time in accordance with a strobe signal STB. The electronic switches 39 change over in accordance with a switching signal KS associated with the print clock ICK. The switches 39 output to the AND gates 31 either the data FPD0–FPD63 or the data SPD0–SPD63 latched by the latch 37 or 38. The AND gates 31 output drive data A0–A63 in accordance with the print clock ICK.

Therefore, as shown in FIG. 15, it is possible to shorten the time interval between the point t5 when the print clock pulse ICKsn−1 for the stop pulse data SDn−1 falls and the point t1 when the print clock pulse ICKfn for the ejection pulse data FDn rises. It is also possible to shorten the time interval between the point t2 when the print clock pulse ICKfn for the ejection pulse data FDn falls and the point t3 when the print clock pulse ICKsn for the stop pulse data SDn rises. Therefore, this embodiment can shorten the period of the cycles Tm−1 and Tm more than the second embodiment can. This improves the print speed further.

Fourth Embodiment

Figure 17:
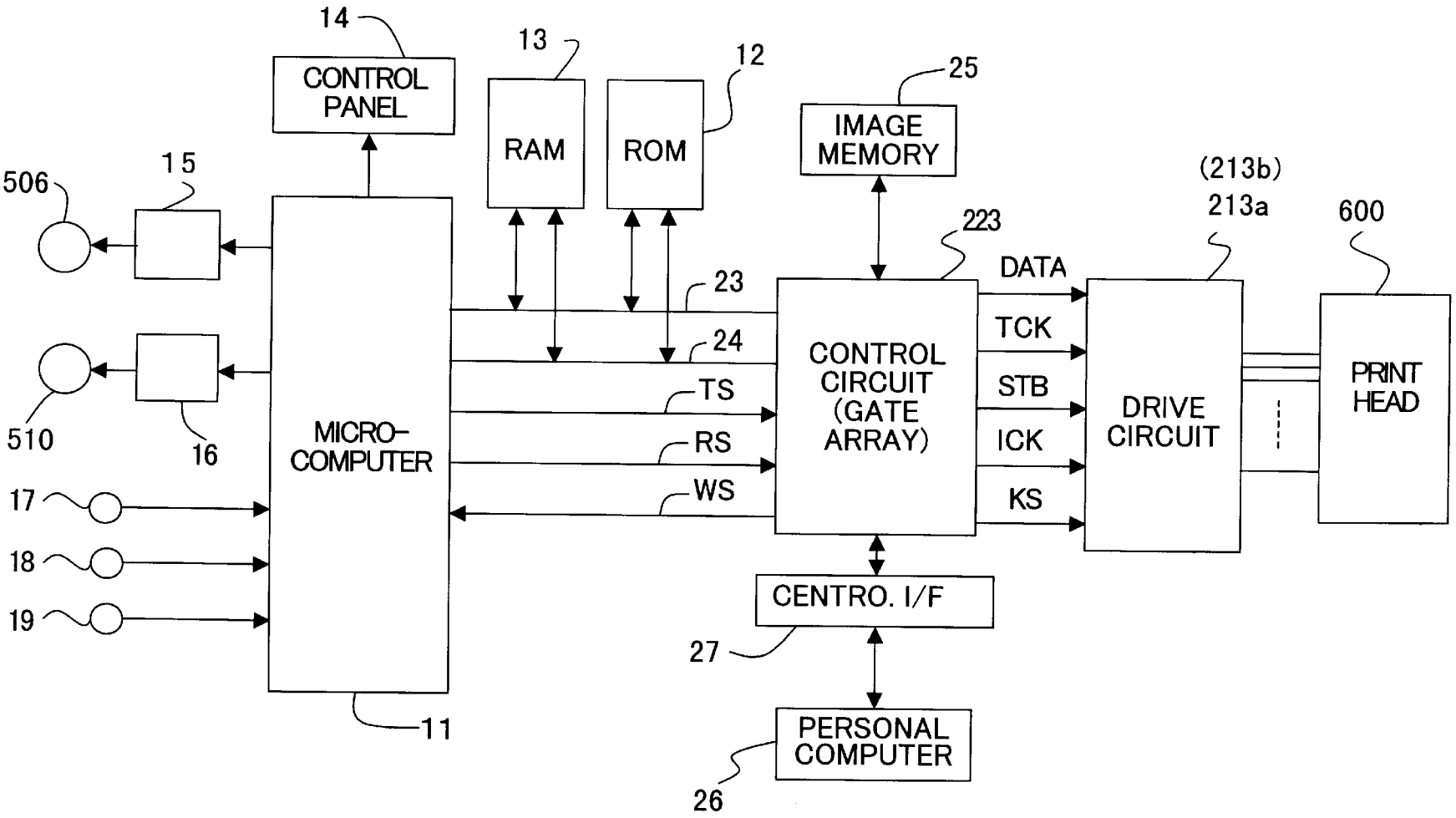
FIG. 17 is a block diagram of the electric system of an ink jet printer including an ink jet apparatus according to a fourth or fifth embodiment of the invention.

The ink jet printer shown in FIG. 17 is similar to the printer shown in FIG. 1 of the first embodiment, but its control circuit 223 and drive circuit 213*a* differ in structure from the circuits 221 and 211. The description of similar Parts will be omitted to avoid repetitious description.

Referring to FIG. 17, this difference in circuit structure necessitate transferring a switching signal KS from the control circuit 223 to the drive circuit 213*a*. The signal KS is used to switch between the ejection of ink from each channel 613 of the print head 600 and the cancellation of the residual pressure wave vibration in the channel. A mechanism and timing for generating a switching signal KS will be described later. The components of this embodiment which are identical to those of the foregoing embodiments are accorded the same reference numerals, and the description of them will be omitted.

Figure 18:
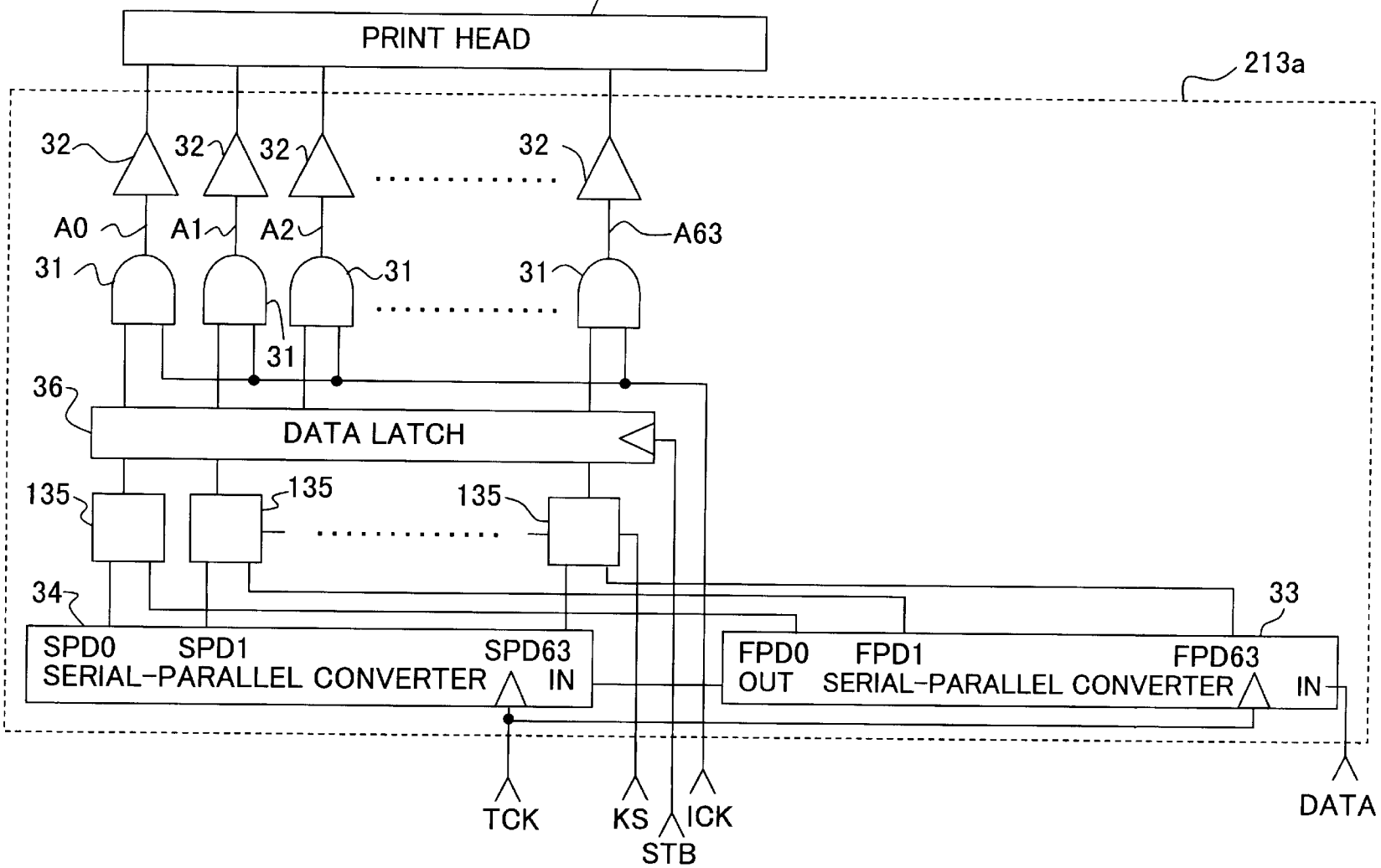
FIG. 18 is a block diagram of the drive circuit of the apparatus according to the fourth embodiment.

Referring to FIG. 18, the drive circuit 213*a* includes 64 output circuits 32, 64 AND gates 31, a data latch 36, 64 data synthesizing and selecting circuits 135, and a pair of serial-parallel converters 33 and 34.

The serial-parallel converters 33 and 34 are similar to those shown in FIGS. 9 and 13 of the second and third embodiments, respectively. When transfer clock pulses TCK rise, however, the converter 34 receives transfer data DATA output serially from the converter 33, and converts them into parallel data SPD0–SPD63. The parallel data SPD0–SPD63 are the transfer data DATA preceding by 64 bits the parallel data FPD0–FPD63 output from the converter 33.

In accordance with a switching signal KS transferred from the control circuit 223, the data synthesizing and selecting circuits 135 can produce ejection pulse data FD for ink ejection and stop pulse data SD for vibration cancellation from parallel data FPD0–FPD63 and SPD0–SPD63, respectively.

Figure 19:
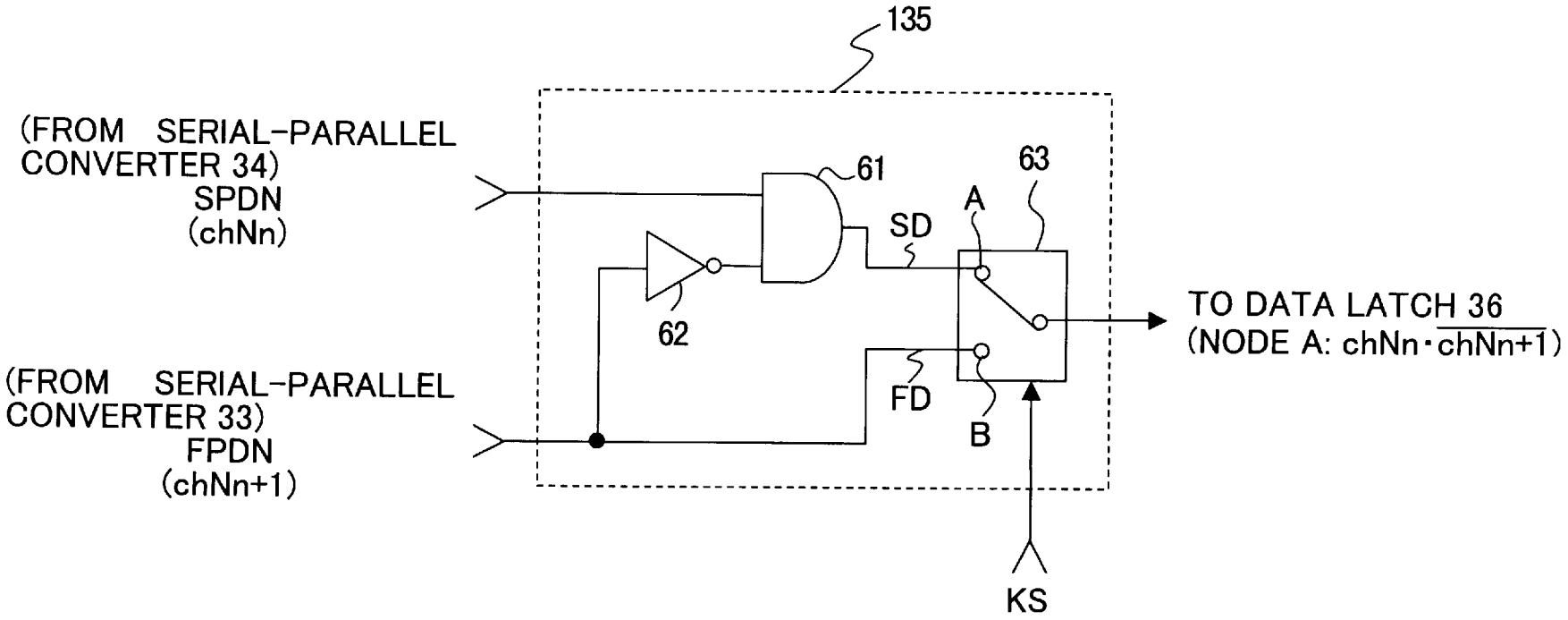
FIG. 19 is a block diagram of one of the electronic switches of the drive circuit shown in FIG. 18.

Referring to FIG. 19, each data synthesizing and selecting circuit 135 consists of an inverter gate 62, an AND gate 61 and an electronic switch 63, which has a node A and a node B.

The inverter gate 62 inverts the logical level of one data FPDN out of parallel data FPD0–FPD63 output from the serial-parallel converter 33. The AND gate 61 outputs the logical product of the output from the inverter gate 62 and the associated one data SPDN of parallel data SPD0–SPD63 from the converter 34. The data FPD0–FPD63 are associated with the data SPD0–SPD63, respectively.

In accordance with the switching signal KS, the 64 electronic switches 63 change over to their respective nodes A or B. If the switches 63 change over to the nodes B, they select the outputs from the serial-parallel converter 33. If the switches 63 change over to the nodes A, they select the outputs from the AND gates 61. The switches 63 output the selected outputs to the data latch 36. Stop pulse data SD are output from the nodes A, and ejection pulse data FD are output from the nodes B. That is to say, in accordance with the switching signal KS, the data synthesizing and selecting circuits 135 output stop pulse data SD0–SD63 or ejection pulse data FD0–FD63. The waveform (switching timing) of the switching signal KS will be described later.

Returning to FIG. 18, when a strobe pulse STB transferred from the control circuit 223 rises, the data latch 36 latches stop pulse data SD0–SD63 or ejection pulse data FD0–FD63. The latch 36 outputs the latched data to the AND gates 31.

Similarly to the AND gates 31 shown in FIGS. 3 and 9, the AND gates 31 of this embodiment output drive data A0–A63. The data A0–A63 are the logical products of stop pulse data SD0–SD63 or ejection pulse data FD0–FD63, respectively, and a print clock ICK transferred from the control circuit 223.

On the basis of the drive data A0–A63, the output circuits 32 can generate a voltage which is suitable for the print head 600. Each circuit 32 can output the voltage to the associated channel electrode 619 of the head 600.

No details of the control circuit 223 are illustrated. It may be possible to form a control circuit 223 by so adapting the control circuit 221 of FIG. 4 as to omit the shift register 43, AND gate 44, inverter gate 45 and electronic switch 46 from this circuit, and to connect the output terminal OUT of the shift register 42 of this circuit to the input terminal IN of the serial-parallel converter 33 of the drive circuit 213*a*. Similarly to the control circuit 221 of the first embodiment, the control circuit 223 can generate a transfer clock TCK, a switching signal KS, a strobe signal STB and a print clock ICK, which are transferred to the drive circuit 213*a*.

Figure 20:
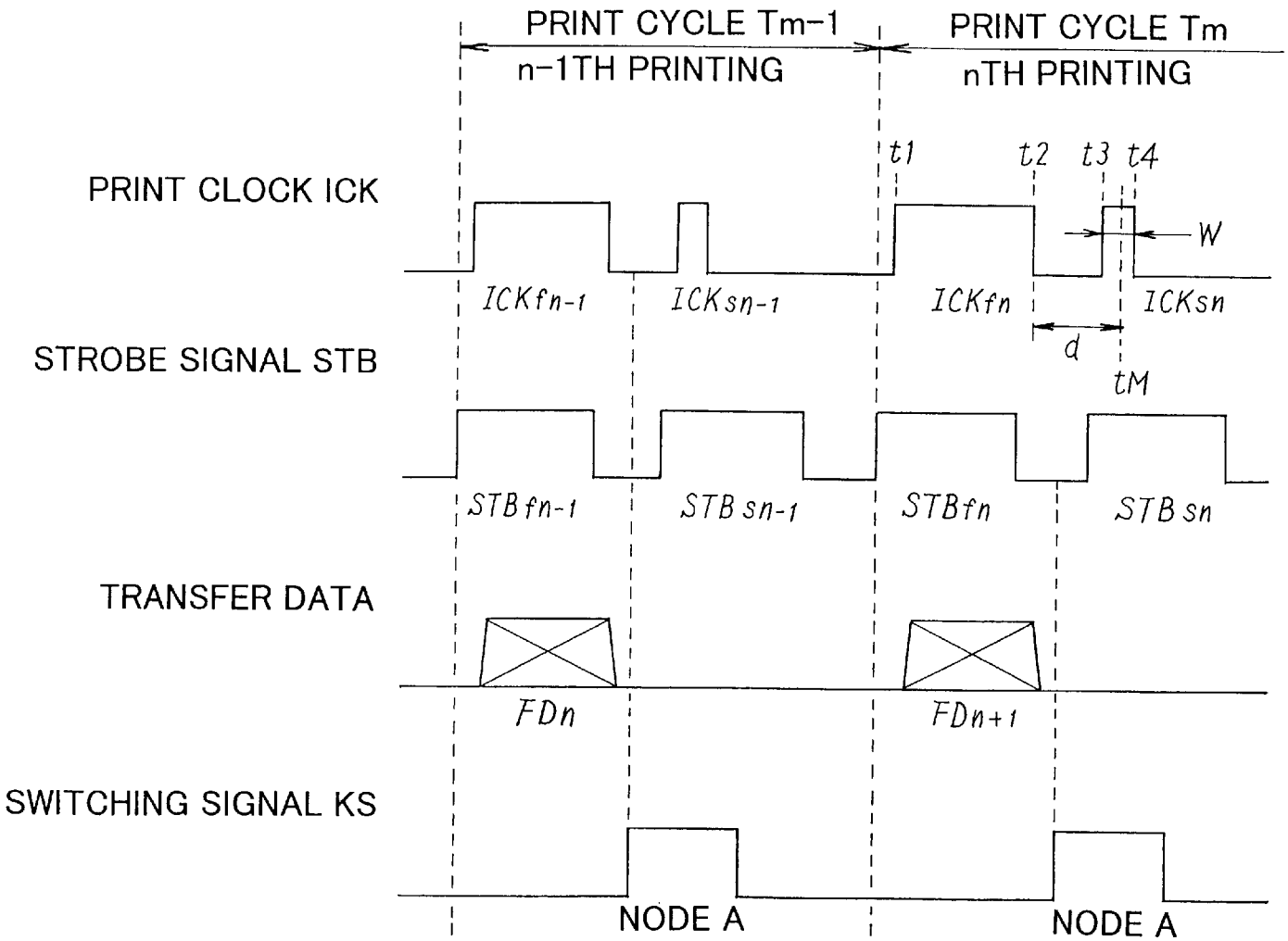
FIG. 20 is a time chart showing the operation of the apparatus according to the fourth embodiment.

Referring to FIG. 20, the operation of the ink jet apparatus of this embodiment will be described. FIG. 20 is a time chart of the print clock ICK, strobe signal STB, transfer data DATA and switching signal KS during the data transfer from the control circuit 223 to the drive circuit 213*a* in print cycles Tm−1 and Tm. This chart will be explained in comparison with the chart shown in FIG. 5 of the first embodiment.

The print clocks ICK shown in FIGS. 20 and 5 have similar waveforms. Specifically, in each print cycle, a print clock pulse ICKf is transferred for ejection pulse data FD, and subsequently a print clock pulse ICKs is transferred for stop pulse data SD.

The strobe signals STB shown in FIGS. 20 and 5, too, have similar waveforms. The strobe signal STB in the print cycle Tm−1 consists of a preceding pulse STBfn−1 and a succeeding pulse STBsn−1. The rise of the preceding pulse STBfn−1 is the trigger for the data latch 36 of the drive circuit 213*a* to latch the ejection pulse data FDn−1. The rise of the succeeding pulse STBsn−1 is the trigger for the latch 36 to latch the stop pulse data SDn−1.

With respect to the transfer data DATA, the control circuit 221 of the first embodiment produces stop pulse data SD and ejection pulse data FD, which are transferred separately through the electronic switch 46 to the drive circuit 211.

In this embodiment, the stop pulse data SD and ejection pulse data FD are produced in the drive circuit 213*a*, not the control circuit 223. Therefore, the data transferred from the circuit 223 to the circuit 213*a* are only FDn. As is the case with the first embodiment, the transfer data DATA transferred in the print cycle Tm−1 are the ejection pulse data FDn for the "n"th printing, which are associated with image data ch0n–ch63n. The data DATA transferred in the cycle Tm are the ejection pulse data FDn+1 for the "n+1"th printing, which are associated with image data ch0n+1–ch63n+1.

The switching signal KS is shown as on or high in logical level when the electronic switches 63 are switched to the nodes A. Each switching signal pulse KS rises before the associated strobe pulse STBs for stop pulse data SD is transferred.

A description will be given of the operation of the drive circuit 213*a* during the transfer of signals and data at the timing shown in FIG. 20.

Before the ejection pulse data FDn are transferred in the print cycle Tm−1, the serial-parallel converter 33 outputs the ejection pulse data FDn−1 (FPD0–FPD63 in FIG. 18), which are the "n−1"th print data. In the meantime, a switching signal pulse KS for switching the electronic switches 63 to the nodes B is input to the data synthesizing and selecting circuits 135. Therefore, the data FDn−1 from the converter 33 are input to the data latch 36. With the data FDn−1 in the data latch 36, the associated strobe pulse STBfn−1 is transferred, latching in the latch 36 the data for the associated print clock pulse ICKfn−1.

Next, in the print cycle Tm−1, the ejection pulse data FDn are transferred to the serial-parallel converter 33. In this cycle, the converter 33 outputs the ejection pulse data FDn, which are the "n"th print data. In the meantime, the converter 34 outputs the ejection pulse data FDn−1 (SPD0–SPD63 in FIG. 18), which are the "n−1"th print data. A switching signal pulse KS for switching the electronic switches 63 to the nodes A is input to the data synthesizing and selecting circuits 135. Therefore, the stop pulse data SDn−1 for the "n−1"th printing are input to the data latch 36. The data SDn−1 are the image data ch0n−1·$\overline{\text{ch0n−1}}$–ch63n−1·$\overline{\text{ch63n−1}}$. With the data SDn−1 in the data latch 36, the associated strobe pulse STBsn−1 is transferred, latching in the latch 36 the data for the associated print clock pulse ICKsn−1.

As is the case with the first embodiment, the AND gates 31 output the logical products of the latched data and the associated bit data of the print clock ICK. On the basis of the logical product from each AND gate 31, the associated output circuit 32 can drive the associated ink channel 613 of the print head 600 to cancel the residual pressure wave vibration.

Therefore, in this embodiment as well, it is possible to switch securely between the execution and no execution of the vibration cancellation, depending on whether there is a print command for the print cycle following a certain print cycle.

Fifth Embodiment

Figure 21:
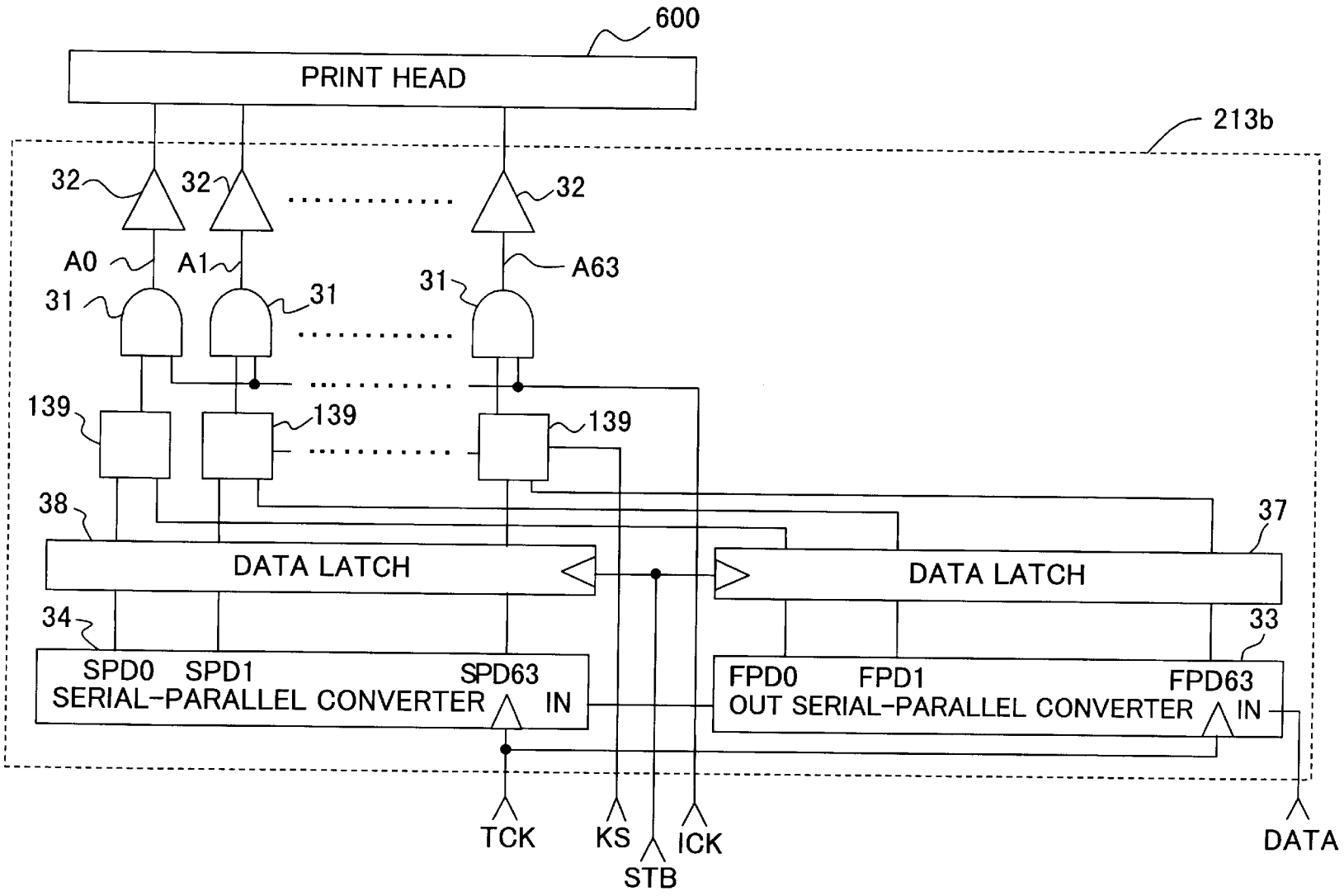
FIG. 21 is a block diagram of the drive circuit of the apparatus according to the fifth embodiment.
Figure 22:
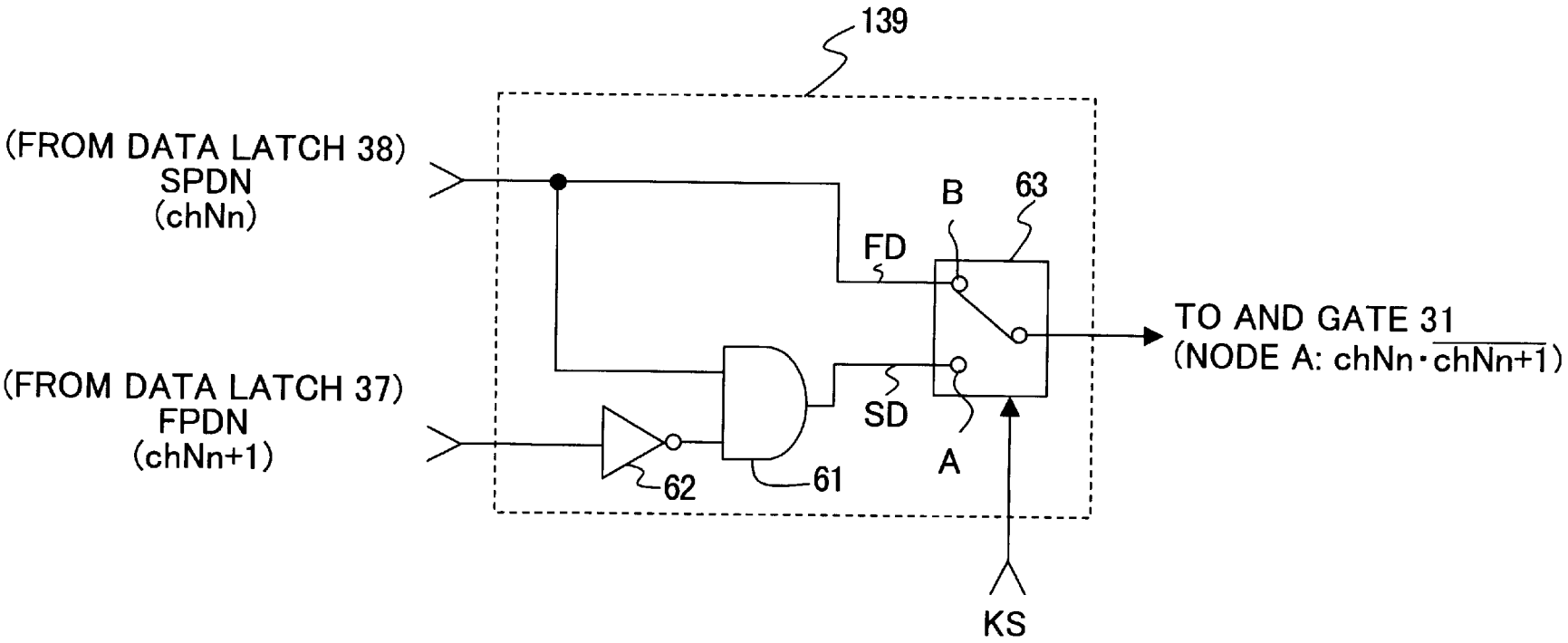
FIG. 22 is a block diagram of one of the electronic switches of the drive circuit shown in FIG. 21.
Figure 23:
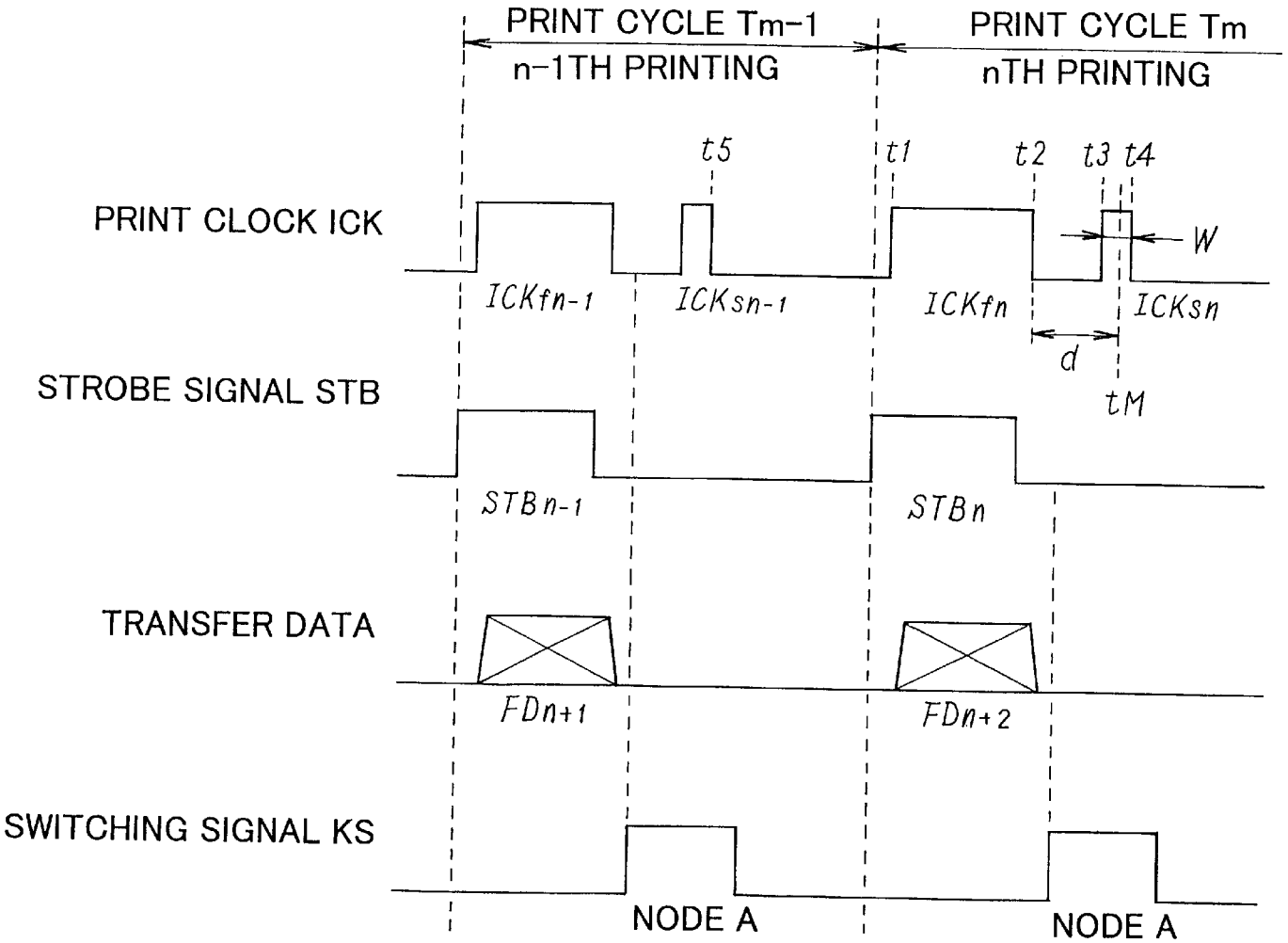
FIG. 23 is a time chart showing the operation of the apparatus according to the fifth embodiment.

Referring to FIGS. 21, 22 and 23, a fifth embodiment of the invention will be described in comparison with the fourth. Parts of the fifth embodiment which are identical or equivalent to those of the fourth are accorded the same reference numerals, and the description of them will be omitted.

FIG. 21 shows a drive circuit 213*b* of this embodiment. The circuit 213*b* is a modification of the circuit 213*a* shown in FIG. 18. The circuit 213*b* includes a pair of serial-parallel converters 33 and 34 and a pair of data latches 37 and 38, which are connected to the converters 33 and 34, respectively, to receive parallel data from them.

When a strobe pulse STB transferred from a control circuit 223 (FIG. 17) rises, the data latches 37 and 38 latch parallel data FPD0–FPD63 and SPD0–SPD63 output from the serial-parallel converters 33 and 34, respectively.

In accordance with a switching signal KS transferred from the control circuit 223, 64 data synthesizing and selecting circuits 139 produce ejection pulse data FD for ink ejection and stop pulse data SD for vibration cancellation from parallel data FPD0–FPD63 and SPD0–SPD63 output from the data latches 37 and 38, respectively.

Referring to FIG. 22, each data synthesizing and selecting circuit 139 is similar to the circuit 135 shown in FIG. 19. The circuit 139 consists of an inverter gate 62, an AND gate 61 and an electronic switch 63, which has a node A and a node B.

The inverter gate 62 inverts the logical level of one data FPDN out of parallel data FPD0–FPD63 output from the data latch 37. The AND gate 61 outputs the logical product of the output from the inverter gate 62 and the associated one data SPDN of parallel data SPD0–SPD63 from the latch 38.

In accordance with the switching signal KS, the 64 electronic switches 63 change over to their respective nodes A or B. If the switches 63 change over to the nodes B, they select the outputs from the data latch 38. If the switches 63 change over to the nodes A, they select the outputs from the AND gates 61. The switches 63 output the selected outputs to the respective AND gates 31. Stop pulse data SD are output from the nodes A, and ejection pulse data FD are output from the nodes B.

The drive circuit 213*b* differs from the circuit 213*a* of FIG. 18 in that, after the outputs from the serial-parallel converters 33 and 34 are latched by the data latches 37 and 38, respectively, the data synthesizing and selecting circuits 139 produce stop pulse data SD or ejection pulse data FD, and send them to the respective AND gates 31.

Referring to FIG. 23, the operation of the ink jet apparatus of this embodiment will be described. FIG. 23 is a time chart of the print clock ICK, strobe signal STB, ejection pulse data FD, stop pulse data SD and switching signal KS in print cycles Tm−1 and Tm.

The print clock ICK and switching signal KS are similar in waveform to those of the fourth embodiment.

In the print cycle Tm−1, the ejection data FDn+1 for the "n+1"th printing are transferred.

As shown in FIG. 21, the strobe signal STB is input to the data latches 37 and 38 after it enters the drive circuit 213*b*. Therefore, in contrast to the fourth embodiment, the strobe signal STB in the print cycle Tm−1 has only a pulse STBn−1.

A further detailed description will be given of the operation of the drive circuit 213*b* during the transfer of signals and data at the timing shown in FIG. 23.

Before the ejection pulse data FDn+1 are transferred in the print cycle Tm−1, the serial-parallel converter 33 converts serial ejection pulse data FDn into parallel data FPD0n–FPD63n (associated with image data ch0n–ch63n, respectively), and outputs the parallel data. At the same time, the converter 34 converts serial ejection pulse data FDn−1 into parallel data SPD0n−1–SPD63n−1 (associated with image data ch0n−1–ch63n−1, respectively), and outputs the parallel data.

In the print cycle Tm−1, when the strobe pulse STBn−1 rises, the data latch 37 latches the image data ch0n–ch63n output from the serial-parallel converter 33. At the same time, the latch 38 latches the image data ch0n−1–ch63n−1 output from the converter 34.

In the print cycle Tm−1, the AND gates 61 of the data synthesizing and selecting circuits 139 receive the image data ch0n–ch63n from the data latch 37 through the inverter gates 62 and the image data ch0n−1–ch63n−1 from the latch 38. As a result, the stop pulse data SD0n−1–SD63n−1 for the "n−1"th printing are output from the nodes A of the electronic switches 63, and the ejection pulse data FD0n−1–FD63n−1 for the "n−1"th printing are output from the nodes B.

In the print cycle Tm−1, when the print clock pulse ICKsn−1 associated with the stop pulse data SDn−1 is transferred, the switching signal KS switches the electronic switches 63 of the data synthesizing and selecting circuits 139 to the nodes A. Otherwise, in the cycle Tm−1, the switches 63 are switched to the nodes B.

If the print clock ICK is high in logical level, the output from each AND gate 31 of the drive circuit 213*b* depends on the output from the associated data synthesizing and selecting circuit 139. If the clock ICK is low in logical level, the output from each AND gate 31 is low in logical level regardless of the output from the associated circuit 139.

As described in detail, and as is the case with the fourth embodiment, it is possible to switch securely between the execution and no execution of the vibration cancellation, depending on whether there is a print command for the print cycle following a certain print cycle.

In this embodiment, parallel data FPD0–FPD63 output from the serial-parallel converter 33 are latched once by the data latch 37. Likewise, parallel data SPD0–SPD63 output from the converter 34 are latched once by the latch 38. In accordance with the switching signal KS, which is synchronous with the print clock ICK, the data synthesizing and selecting circuits 139 selectively output ejection pulse data FD or stop pulse data SD to the respective AND gates 31.

This, in comparison with the fourth embodiment, shortens the time for transferring the strobe signal STB. Therefore, as shown in FIG. 23, it is possible to shorten the time interval between the point t5 when the print clock pulse ICKsn−1 for the stop pulse data SDn−1 falls and the point t1 when the print clock pulse ICKfn for the ejection pulse data FDn rises. It is also possible to shorten the time interval between the point t2 when the print clock pulse ICKfn falls and the point t3 when the print clock pulse ICKsn for the stop pulse data SDn rises. Therefore, this embodiment can shorten the period of the cycles Tm−1 and Tm more than the fourth embodiment can. This improves the print speed further.

The invention is not limited to the foregoing embodiments, but modifications and/or variations may be made as follows with effects similar to those of the embodiments:

(1) In each print cycle of each embodiment, only one print clock pulse ICKf is generated for the ejection pulse data FD. Otherwise, two or more print clock pulses ICKf might be generated for the data FD. The print clock pulses ICKf in each print cycle are equal in number to the ink droplets ejected out through each associated nozzle 618. Therefore, a larger number of print clock pulses ICKf for the ejection pulse data FD in each print cycle result in a larger number of ejected ink droplets. This increases the print density to form a thicker and clearer image.

(2) In each embodiment, the width of the print clock pulses ICKf for the ejection pulse data FD is equal to the one-way propagation delay time T. Otherwise, the pulse width might be about an odd number of times as large as the time T. The third embodiment has more degrees of freedom to vary the pulse width than the second. This makes it easier for the third embodiment to optimize the waveform of the print clock ICK for the structure of the print head 600.

(3) In each embodiment, the width W of the print clock pulses ICKs for the stop pulse data FD is half (0.5) of the one-way propagation delay time T. Otherwise, this pulse width might be any such value that no ink is ejected from one or more of the channels 613, but the residual pressure wave vibration therein is cancelled securely. However, the optimum width W of the print clock pulses ICKs is determined on the basis of the one-way propagation delay time T.

(4) In each embodiment, the print clock pulse ICKfn falls at the point t2, and the print clock pulse ICKsn rises and falls at the points t3 and t4, respectively. The time "d" between the point t2 and the middle point tM between the points t3 and t4 is 2.5 times as long as the one-way propagation delay time T. The time "d" might, however, be any other value for secure cancellation of the residual pressure wave vibration, but the optimum time "d" is determined on the basis of the one-way propagation delay time T. The third embodiment has more degrees of freedom to vary the time "d" than the second. This makes it easier for the third embodiment to optimize the waveform of the print clock ICK for the structure of the print head 600.

(5) The serial data output from the shift register 42 of each embodiment are input through the inverter gate 45 to the AND gate 44. Otherwise, the serial data output from the register 42 might be input directly to the AND gate 44. Instead, the serial data output from the shift register 43 might be input through the inverter gate 45 to the AND gate 44.

(6) The output circuits 32 of each embodiment generate the same positive voltage to eject ink and cancel vibration. Otherwise, the voltage generated for vibration cancellation by the circuits 32 might be lower than the voltage generated for ink ejection by them, or be negative.

(7) In each embodiment, the upper parts 605 and lower parts 607 of the actuator walls of the print head 600 can deform piezoelectrically to change the volume of the channels 613. Otherwise, one of the parts 605 and 607 of each actuator wall might be made of material which cannot deform piezoelectrically. In this case, the piezoelectric deformation of the piezoelectric wall part 605 or 607 deforms the other part to eject ink.

(8) The channels 613 of each embodiment alternate with the spaces 615. Otherwise, no spaces 615 might be formed, and the channels 613 might adjoin.

(9) The shear mode actuator walls 603*a*–603*h* of each embodiment may be replaced with walls of laminated piezoelectric material. In this case, the deformation of the walls in the direction of lamination generates pressure waves. The walls 603*a*–603*h* may not be limited to piezoelectric walls, but may be modified and/or improved for generation of pressure waves in the channels 613 on the basis of the knowledge of those skilled in the art. However, the piezoelectric actuator walls 603*a*–603*h* of each embodiment simplify the construction of the print head 600, improve the durability thereof and reduce the production costs therefor.

(10) Each embodiment is applied to a printer in which the print head 600 can reciprocate with the carriage 504, but might also be applied to another printer like a line printer with a print head fixed to its body.

(11) In each embodiment, the residual pressure wave vibration in each channel 613 is cancelled to be damped completely. Otherwise, the vibration might be cancelled to be damped to such a degree that no ink may be ejected from the channel 613.

What is claimed is:

1. An ink jet apparatus for a printer, comprising:

an ink jet head having a nozzle and an ink channel formed therein, the nozzle and the channel communicating with each other, the head also having an actuator for changing the volume of the channel to eject ink from the channel through the nozzle;

a drive unit for driving the actuator;

a control unit for generating a print data for every print cycle and controlling the drive unit with the data; and a stop pulse data generator for carrying out a logical operation of the print data for each print cycle Tm and the print data for the next print cycle Tm+1 to generate a stop pulse data if the data for the cycle Tm is a data for execution of printing and if the data for the cycle Tm+1 is a data for no execution of printing;

the drive unit driving the actuator based on the stop pulse data so as to damp pressure wave vibration generated in the channel after the execution of printing in accordance with the print data for the print cycle Tm.

2. An ink jet apparatus as defined in claim 1, wherein the logical operation is the logical multiply of the print bit data in the print cycle Tm and the inverse of the print bit data in the next cycle Tm+1.

3. An ink jet apparatus as defined in claim 1, wherein the stop pulse data generator is positioned in the control unit.

4. An ink jet apparatus as defined in claim 1, and further comprising a first storer for storing the print data for every print cycle and a second storer for storing the print data for every print cycle, the second storer storing the data for the print cycle Tm+1 when the first storer stores the data for the cycle Tm, the stop pulse data generator generating the stop pulse data by carrying out the logical operation of the data stored in the first and second storers.

5. An ink jet apparatus as defined in claim 4, and further comprising a data selector connected to the drive unit for selecting the stop pulse data output from the stop pulse data generator or the print data output from the second storer, the selector selecting and outputting to the drive unit the print data in the second storer after selecting and outputting to the drive unit the stop pulse data during the print cycle Tm.

6. An ink jet apparatus as defined in claim 5, wherein the nozzle consists of sub-nozzles, the ink channel consisting of sub-channels, the actuator consisting of sub-actuators, the sub-nozzles each communicating with one of the sub-channels, the sub-actuators each being able to change the volume of one of the sub-channels, the apparatus further comprising:

a memory for storing a plurality of print data each associated with one of the sub-actuators;

the second storer carrying out a serial-parallel conversion of print data by storing a plurality of print data transferred in parallel from the memory, and by outputting the stored data in series, the second storer feeding back the serially output data thereto;

the first storer serially receiving the data output serially from the second storer, the first storer serially outputting the received data in synchronism with the serial output from the second storer if the data selector selects the stop pulse data;

the stop pulse data generator generating the stop pulse data by carrying out the logical operation of the data output in series from the first and second storers.

7. An ink jet apparatus as defined in claim 6, wherein the control unit generates a print clock consisting of first pulses associated with ejection of ink from the ink channels and second pulses associated with cancellation of pressure wave vibration generated in the channels, the drive unit further including:

a serial-parallel converter for carrying out a serial-parallel conversion of print data or stop pulse data by storing the print data or the stop pulse data output in series from the data selector of the control unit, and by outputting the stored data in parallel; and a drive data generator for generating a plurality of drive data each associated with one of the print data or the stop pulse data, by carrying out a logical operation of each print data or each stop pulse data output in parallel from the serial-parallel converter and the print clock generated from the control unit.

8. An ink jet apparatus as defined in claim 7, and further comprising a drive signal generator for generating drive signals for driving the sub-actuators on the basis of the drive data generated from the drive data generator.

9. An ink jet apparatus as defined in claim 4, wherein the nozzle consists of sub-nozzles, the ink channel consisting of sub-channels, the actuator consisting of sub-actuators, the sub-nozzles each communicating with one of the sub-channels, the sub-actuators each being able to change the volume of one of the sub-channels, the apparatus further comprising:

a memory for storing a plurality of print data each associated with one of the sub-actuators;

the second storer storing a plurality of data transferred in parallel from the memory, carrying out a serial-parallel conversion of the stored data and outputting the serial data;

the first storer receiving the data from the second storer while outputting the data for the print cycle preceding the cycle associated with the received data;

the stop pulse data generator generating the stop pulse data by carrying out the logical operation of the data output in series from the first and second storers.

10. An ink jet apparatus as defined in claim 9, wherein the control unit generates a print clock including in each print cycle a first pulse associated with ejection of ink from the sub-channels and a second pulse associated with cancellation of pressure wave vibration generated in the sub-channels, the control unit also generating a switching signal in synchronism with the clock, the drive unit further including:

a first serial-parallel converter for storing the print data output in series from the second storer of the control unit, carrying out a serial-parallel conversion of the stored print data and outputting the parallel print data;

a second serial-parallel converter for storing the stop pulse data output in series from the stop pulse data generator of the control unit, carrying out a serial-parallel conversion of the stored stop pulse data and outputting the parallel stop pulse data;

a data selector for selecting, in accordance with the switching signal generated by the control unit, the print data output from the first converter or the stop pulse data output from the second converter, the selector selecting print data and thereafter stop pulse data during each print cycle; and a drive data generator for generating a plurality of drive data each associated with one of the print data, by carrying out a logical operation of each print data or each stop pulse data selected by the selector and the print clock generated by the control unit.

11. An ink jet apparatus as defined in claim 10, wherein the drive unit further includes a third storer for storing, in synchronism with the print clock generated by the control unit, the print data or the stop pulse data selected by the data selector, the drive data generator generating the drive data by carrying out the logical operation of each print data or each stop pulse data stored in the third storer and the print clock.

12. An ink jet apparatus as defined in claim 10, wherein the drive unit further includes:

a fourth storer for storing in synchronism with the print clock the print data output in parallel from the first serial-parallel converter; and a fifth storer for storing in synchronism with the print clock the stop pulse data output in parallel from the second serial-parallel converter;

the data selector selecting the print data in the fourth storer and thereafter the stop pulse data in the fifth storer during each print cycle in accordance with the switching signal generated by the control unit.

13. An ink jet apparatus as defined in claim 12, and further comprising a drive signal generator for generating drive signals for driving the sub-actuators on the basis of the drive data generated from the drive data generator.

14. An ink jet apparatus as defined in claim 1, wherein the nozzle consists of sub-nozzles, the ink channel consisting of sub-channels, the actuator consisting of sub-actuators, the sub-nozzles each communicating with one of the sub-channels, the sub-actuators each being able to change the volume of one of the sub-channels;

the control unit generating a print clock including in each cycle a first pulse associated with ejection of ink from the sub-channels and a second pulse associated with cancellation of pressure wave vibration generated in the sub-channels, the control unit also generating a switching signal in synchronism with the clock, the control unit serially outputting a plurality of print data each associated with one of the sub-actuators;

the drive unit including:

a first serial-parallel converter for storing the print data output in series from the control unit, outputting the stored data in series, carrying out a serial-parallel conversion of the stored data and outputting the parallel data; and a second serial-parallel converter for receiving the print data output in series from the first converter, carrying out a serial-parallel conversion of the received data and outputting the parallel data;

the stop pulse data generator generating the stop pulse data by carrying out the logical operation of the print data output in parallel from the first and second converters;

the drive unit further including:

a data selector for selecting, in accordance with the switching signal generated by the control unit, the print data output in parallel from the first converter or the stop pulse data output in parallel from the stop pulse data generator; and a drive data generator for generating a plurality of drive data each associated with one of the print data, by carrying out a logical operation of each print data or each stop pulse data selected by the selector and the print clock generated by the control unit.

15. An ink jet apparatus as defined in claim 14, wherein the drive unit further includes a first storer for storing, in synchronism with the print clock generated by the control unit, the print data or the stop pulse data selected by the data selector, the drive data generator generating the drive data by outputting the logical product of each print data or each stop pulse data stored in the storer and the print clock.

16. An ink jet apparatus as defined in claim 14, wherein the drive unit further includes:

a second storer for storing in synchronism with the print clock the print data output in parallel from the first serial-parallel converter; and a third storer for storing in synchronism with the print clock the print data output in parallel from the second serial-parallel converter, the third storer being connected to the stop pulse data generator;

the data selector selecting the print data in the second storer and thereafter the stop pulse data generated by the stop pulse generator during each print cycle in accordance with the switching signal generated by the control unit.

17. An ink jet apparatus as defined in claim 14, and further comprising a drive signal generator for generating drive signals which are suitable for the sub-actuators on the basis of the drive data generated from the drive data generator.

18. An ink jet apparatus as defined in claim 1, wherein:

the drive unit drives the actuator in each print cycle to first execute ejection of ink from the channel by once increasing and thereafter decreasing, or once decreasing and thereafter increasing, the volume of the channel, and subsequently execute cancellation for damping the pressure wave vibration by again increasing and thereafter decreasing, or again decreasing and thereafter increasing, the channel volume;

the control unit determining, in each print cycle, a first period when the drive unit executes the ejection, a second period when the drive unit executes the cancellation, and a third period after the ejection ends and until the cancellation starts, on the basis of the time which it takes for a pressure wave of ink to be propagated one way in the channel.

19. An ink jet apparatus as defined in claim 18, wherein the drive unit applies drive signals of the same voltage to the actuator for the ejection and the cancellation.

20. An ink jet apparatus as defined in claim 1, wherein the side walls of the ink channel are made piezoelectric material, the actuator consisting of the walls.

21. An ink jet apparatus as defined in claim 5, wherein the data selector consists of a plurality of selectors associated with the sub-actuators, respectively.

22. An ink jet apparatus as defined in claim 14, wherein the data selector consists of a plurality of selectors associated with the sub-actuators, respectively, and the stop pulse data generator consists of a plurality of data generators associated with the sub-actuators, respectively.

23. An ink jet recorder including an ink jet apparatus as defined in claim 1.

* * * * *